US010526768B2

(12) United States Patent
Hijikata et al.

(10) Patent No.: US 10,526,768 B2
(45) Date of Patent: Jan. 7, 2020

(54) HYDRAULIC ENERGY REGENERATION SYSTEM FOR WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 17 days.

(21) Appl. No.: 15/755,964

(22) PCT Filed: Sep. 23, 2016

(86) PCT No.: PCT/JP2016/077961
§ 371 (c)(1),
(2) Date: Feb. 27, 2018

(87) PCT Pub. No.: WO2018/055723
PCT Pub. Date: Mar. 29, 2018

(65) Prior Publication Data

US 2019/0063039 A1 Feb. 28, 2019

(51) Int. Cl.
*E02F 9/22* (2006.01)
*F15B 11/16* (2006.01)
(Continued)

(52) U.S. Cl.
CPC ..... *E02F 9/2217* (2013.01); *E02F 9/2228* (2013.01); *E02F 9/2271* (2013.01);
(Continued)

(58) Field of Classification Search
CPC ..... F15B 21/14; F15B 11/024; F15B 1/027; F15B 11/16; F15B 1/024; E02F 9/2217; E02F 9/2271
See application file for complete search history.

(56) References Cited

U.S. PATENT DOCUMENTS 9,279,236 B2 * 3/2016 Zhang ..... E02F 9/2217
10,066,368 B2 * 9/2018 Hijikata ..... F15B 11/024
2015/0354172 A1 12/2015 Hijikata et al.

FOREIGN PATENT DOCUMENTS

JP 2009-127643 A 6/2009
JP 2015-520347 A 7/2015
(Continued)

OTHER PUBLICATIONS

English translation (International Search Report (PCT/ISA/210) issued in PCT Application No. PCT/JP2016/077961 dated Nov. 29, 2016) previously filed on Feb. 27, 2018 (one page).
(Continued)

*Primary Examiner* — Abiy Teka
(74) *Attorney, Agent, or Firm* — Crowell & Moring LLP

(57) ABSTRACT

A hydraulic energy regeneration system for a work machine for boosting a pressure of a return hydraulic fluid of a hydraulic cylinder and regenerating the hydraulic fluid, prevents a bottom pressure from reaching an overload relief set pressure and suppresses a changeover shock to ensure favorable operability.

The hydraulic energy regeneration system for the work machine, includes: a communication pressure boost passage that can boost a pressure of a discharge-side hydraulic fluid by communicating a discharge side and a suction side of the hydraulic cylinder with each other during an own weight fall of a driven body; a communication pressure boost valve that is disposed in the communication pressure boost passage and that can regulate one of or both of a pressure and a flow rate of the communication pressure boost passage; a reuse-side line and a reuse control valve or a regeneration-side line and a regeneration control valve that can regenerate a hydraulic fluid discharged from the hydraulic cylinder during the own weight fall of the driven body; and a controller. The controller is configured to reduce an opening degree of
(Continued)

the communication pressure boost valve in response to an increase of the discharge-side pressure of the hydraulic cylinder right after the discharge-side pressure reaches a preset high load set pressure, and gradually reduces the opening degree of the communication pressure boost valve with passage of time.

8 Claims, 13 Drawing Sheets

(51) Int. Cl.

| | |
|---|---|
| ***F15B 1/02*** | (2006.01) |
| ***F15B 1/027*** | (2006.01) |
| ***F15B 11/024*** | (2006.01) |
| ***E02F 9/26*** | (2006.01) |
| ***F15B 21/14*** | (2006.01) |

(52) U.S. Cl.

CPC ..... *E02F 9/2285* (2013.01); *E02F 9/268* (2013.01); *F15B 1/024* (2013.01); *F15B 1/027* (2013.01); *F15B 11/024* (2013.01); *F15B 11/16* (2013.01); *F15B 21/14* (2013.01); *E02F 9/2292* (2013.01); *E02F 9/2296* (2013.01); *F15B 2211/205* (2013.01); *F15B 2211/212* (2013.01); *F15B 2211/40515* (2013.01); *F15B 2211/413* (2013.01); *F15B 2211/428* (2013.01); *F15B 2211/513* (2013.01); *F15B 2211/528* (2013.01); *F15B 2211/6306* (2013.01); *F15B 2211/6336* (2013.01); *F15B 2211/6653* (2013.01); *F15B 2211/6654* (2013.01); *F15B 2211/7053* (2013.01); *F15B 2211/862* (2013.01); *F15B 2211/87* (2013.01); *F15B 2211/875* (2013.01); *F15B 2211/88* (2013.01)

(56) References Cited

FOREIGN PATENT DOCUMENTS

| | | |
|---|---|---|
| WO | WO 2014/112566 A1 | 7/2014 |
| WO | WO 2016/051579 A1 | 4/2016 |

OTHER PUBLICATIONS

International Search Report (PCT/ISA/201) issued in PCT Application No. PCT/JP2016/077961 dated Nov. 29, 2016 with English translation three (3) pages).

Japanese-language Written Opinion (PCT/ISA/237) issued in PCT Application No. PCT/JP2016/077961 dated Nov. 29, 2016 (four (4) pages).

Korean-language Office Action issued in counterpart Korean Application No. 10-2018-7003753 dated Jun. 11, 2019 with English translation (twelve (12) pages).

International Preliminary Report on Patentability (PCT/IB/338 & PCT/IB/373) issued in PCT Application No. PCT/JP2016/077961 dated Apr. 4, 2019, (Japanese-language Written Opinion (PCT/ISA/237) previously filed on Feb. 27, 2018 (seven pages).

* cited by examiner

HYDRAULIC ENERGY REGENERATION SYSTEM FOR WORK MACHINE

TECHNICAL FIELD

The present invention relates to a hydraulic energy regeneration system for a work machine.

BACKGROUND ART

There is known a hydraulic drive system for a work machine including a regeneration circuit that reuses a hydraulic fluid discharged from a boom cylinder by an own weight fall of a boom serving as a driven body for driving an arm cylinder, in which a bottom side and a rod side of the boom cylinder are controlled in such a manner as to communicate the bottom side and the rod side with each other to boost a bottom pressure in order to increase a reuse frequency and achieve further energy saving (refer to, for example, Patent Document 1).

There is also known a hydraulic energy recovery system for recovering energy of a hydraulic fluid discharged from a boom cylinder by an own weight fall of a boom as electric energy, in which the hydraulic energy recovery system includes: a hydraulic motor that is driven by the hydraulic fluid from the boom cylinder; a power generator that is mechanically coupled to the hydraulic motor; and an electrical storage device that stores the electric energy generated by the power generator with a view to ensuring operability equivalent to that of a standard-type construction machine (work machine) without making the hydraulic energy recovery system large in size (refer to, for example, Patent Document 2). In relation to this hydraulic energy recovery system, a technique for improving regeneration efficiency by exercising control in such a manner as to communicate the bottom side and the rod side with each other to boost a bottom pressure, and for converting low pressure, high flow rate hydraulic energy into high pressure, low flow rate hydraulic energy is disclosed similarly to Patent Document 1.

PRIOR ART DOCUMENTS

Patent Documents

Patent Document 1: International Publication No. WO2016/051579

Patent Document 2: International Publication No. WO2014/112566

SUMMARY OF THE INVENTION

Problem to be Solved by the Invention

The techniques for exercising control to communicate the bottom side and the rod side of the boom cylinder with each other and boosting the bottom pressure in Patent Documents 1 and 2 described above have the following common problem.

When the bottom side and the rod side are controlled to communicate with each other during the own weight fall of the boom, the bottom pressure of the boom cylinder is boosted up to twofold. Owing to this, a pressure of an overload relief valve attached for prevention of device damage tends to reach an overload relief set pressure when a high load acts on the boom cylinder, compared with a conventional machine that does not exercise control to communicate the bottom side and the rod side of the boom cylinder with each other.

In the conventional machine, even if loading of soil or suspension of a heavy load that is ordinary work is carried out by a bucket, a bottom pressure does not reach an overload relief set pressure. However, when the bottom side and the rod side are communicated with each other for improving the regeneration efficiency, the bottom pressure is boosted up to twofold. As a result, even when the action described above is carried out, then the bottom pressure reaches the overload relief set pressure, and the boom possibly, inadvertently falls.

On the other hand, Patent Document 2 describes interrupting the communication between the bottom side and the rod side to suppress pressure boosting when the bottom pressure of the cylinder nears the overload relief set pressure. When the communication between the bottom side and the rod side is suddenly interrupted as described above, it is assumed that a changeover shock is generated in response to a sudden change of the pressure and an operator feels discomfort in operation. Nevertheless, Patent Document 2 is silent about explanation as to how to specifically mitigate the changeover shock.

The present invention has been achieved on the basis of the aspects described above. An object of the present invention is to provide a hydraulic energy regeneration system for a work machine for boosting a pressure of a return hydraulic fluid of a hydraulic cylinder and regenerating the hydraulic fluid, capable of preventing a bottom pressure from reaching an overload relief set pressure and capable of suppressing a changeover shock to ensure favorable operability.

Means for Solving the Problems

To solve the problems, the present invention adopts, for example, a configuration according to claims. The present application includes a plurality of means for solving the problem. As an example of the means, there is provided a hydraulic energy regeneration system for a work machine, including: a hydraulic cylinder that contracts during driving of a driven body or an own weight fall of the driven body; a communication pressure boost passage that can boost a pressure of a discharge-side hydraulic fluid by communicating a discharge side and a suction side of the hydraulic cylinder with each other during the own weight fall of the driven body; a communication pressure boost valve that is disposed in the communication pressure boost passage and that can regulate one of or both of a pressure and a flow rate of the communication pressure boost passage; a reuse-side line and a reuse control valve that can reuse a hydraulic fluid discharged from the hydraulic cylinder or a regeneration-side line and a regeneration control valve that can regenerate the hydraulic fluid discharged from the hydraulic cylinder as electric energy, during the own weight fall of the driven body; a first pressure sensor that can detect a discharge-side pressure of the hydraulic cylinder; an operation device that causes the own weight fall of the driven body; an operation amount sensor that detects an operation amount of the operation device; and a controller that inputs therein a signal indicating the discharge-side pressure of the hydraulic cylinder detected by the first pressure sensor and a signal indicating the operation amount of the operation device detected by the operation amount sensor, and that can control the communication pressure boost valve. The controller is configured to reduce an opening degree of the communication pressure boost valve in response to an increase of the discharge-side pressure of the hydraulic cylinder detected by the first pressure sensor right after the discharge-side pressure reaches a preset high load set pressure, and gradually reduces the opening degree of the communication pressure boost valve with passage of time.

Effect of the Invention

According to the present invention, it is possible to prevent a bottom pressure of a boom cylinder from reaching an overload relief set pressure and to suppress a changeover shock in the boom cylinder to ensure the favorable operability even if a high load acts on the boom cylinder.

MODES FOR CARRYING OUT THE INVENTION

Embodiments of the hydraulic energy regeneration system for the work machine according to the present invention are hereinafter described with reference to the drawings.

First Embodiment

Figure 1:
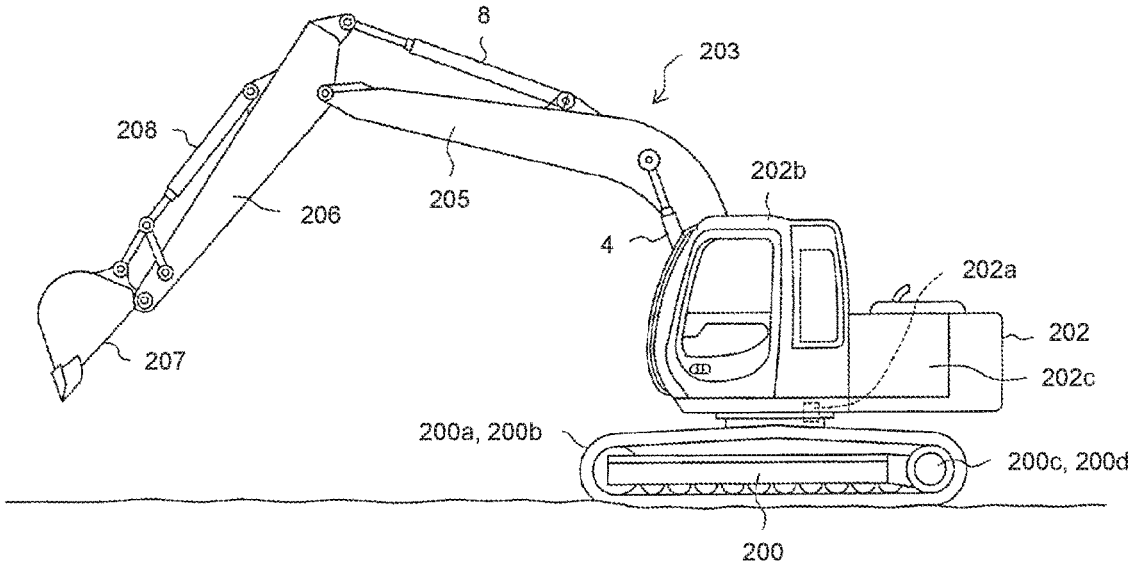
FIG. 1 is a side view showing a hydraulic excavator that mounts a first embodiment of a hydraulic energy regeneration system for a work machine according to the present invention.
Figure 2:
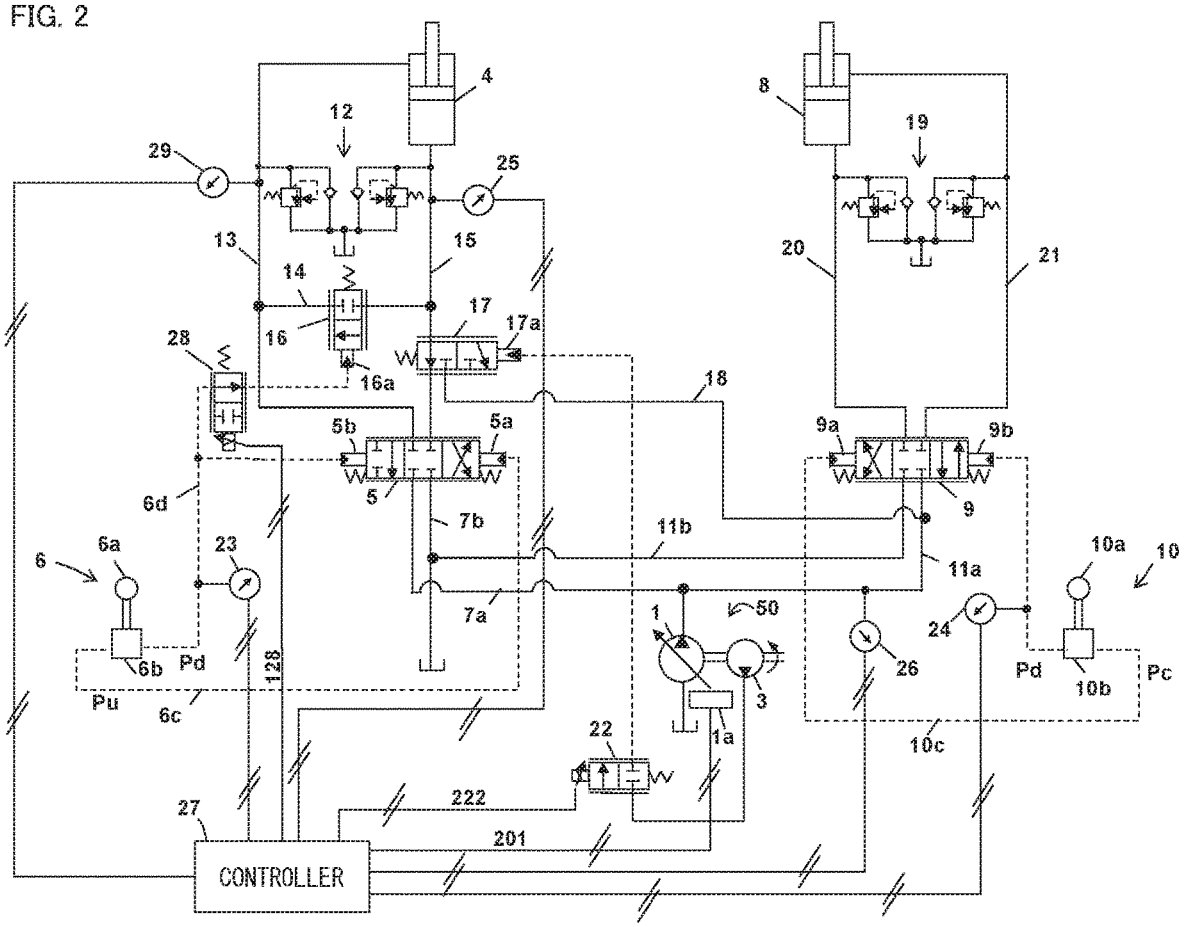
FIG. 2 is a schematic diagram showing the first embodiment of the hydraulic energy regeneration system for the work machine according to the present invention.

FIG. 1 is a side view showing a hydraulic excavator that mounts a first embodiment of a hydraulic energy regeneration system for a work machine according to the present invention. FIG. 2 is a schematic diagram showing the first embodiment of the hydraulic energy regeneration system for the work machine according to the present invention.

In FIG. 1, the hydraulic excavator includes a lower travel structure 200, an upper swing structure 202, and a front work implement 203. The lower travel structure 200 has left and right crawler belt track devices 200*a* and 200*a* (only one of which is shown), and is driven by left and right travel motors 200*b* and 200*b* (only one of which is shown). The upper swing structure 200 is mounted on the lower travel structure 202 in a swingable fashion and driven to swing by a swing motor 202*a*. The front work implement 203 is attached to a front portion of the upper swing structure 202 in such a manner as to be able to be elevated. A cabin (operation room) 202*b* is provided in the upper swing structure 202, and operation devices such as first and second operation devices 6 and 10 (refer to FIG. 2), to be described later, and a travel operation pedal device that is not shown are disposed in the cabin 202*b*.

The front work implement 203 has a multijoint structure that has a boom 205 (first driven body), an arm 206 (second driven body), and a bucket 207. The boom 205 rotates vertically with respect to the upper swing structure 202 by expansion/contraction of a boom cylinder 4, the arm 206 rotates vertically and longitudinally with respect to the boom 205 by expansion/contraction of an arm cylinder 8, and the bucket 207 rotates vertically and longitudinally with respect to the arm 206 by expansion/contraction of a bucket cylinder 208. A relationship between the boom 205 and the boom cylinder 4 is such that expansion of the boom cylinder 4 causes an action of raising the boom 205 and that contraction of the boom cylinder 4 causes an action of lowering the boom 205. It is noted that in a case of an own weight fall of the boom 205, the boom cylinder 4 is shrinked (contracted) by the boom 205.

In FIG. 2, the hydraulic energy regeneration system according to the present embodiment includes a pump device 50 that includes a main hydraulic pump 1 and a pilot pump 3, the boom cylinder 4 (first hydraulic actuator) to which a hydraulic fluid is supplied from the hydraulic pump 1 and which drives the boom 205 (refer to FIG. 1), the arm cylinder (second hydraulic actuator) to which the hydraulic fluid is supplied from the hydraulic pump 1 and which drives the arm 206 (refer to FIG. 1), a control valve 5 (first flow regulation device) that exercises control over a flow (a flow rate and a direction) of the hydraulic fluid supplied from the hydraulic pump 1 to the boom cylinder 4, a control valve 9 (second flow regulation device) that exercises control over a flow (a flow rate and a direction) of the hydraulic fluid supplied from the hydraulic pump 1 to the arm cylinder 8, a first operation device 6 that outputs a boom action command and changes over the control valve 5, and a second operation device 10 that outputs an arm action command and changes over the control valve 9. While the hydraulic pump 1 is connected to a control valve which is not shown so that the hydraulic fluid is supplied to another actuator which is not shown, circuit sections of the actuator and the control valve are not shown.

The hydraulic pump 1, which is a variable displacement pump, includes a regulator 1*a*, a tilting angle (capacity) of the hydraulic pump 1 is controlled and a delivery flow rate of the hydraulic pump 1 is controlled by controlling the regulator 1*a* by control signals from a controller 27 (to be described later). Furthermore, although not shown, the regulator 1*a* has a torque control section to which a delivery pressure of the hydraulic pump 1 is introduced and which controls the tilting angle (capacity) of the hydraulic pump 1 in such a manner that an absorption torque of the hydraulic pump 1 does not exceed a preset maximum torque, as well known. The hydraulic pump 1 is connected to the control valves 5 and 9 via hydraulic fluid supply lines 7*a* and 11*a*, and the fluid delivered from the hydraulic pump 1 is supplied to the control valves 5 and 9.

The control valves 5 and 9, which serve as the flow regulation devices, are connected to bottom-side hydraulic chambers or rod-side hydraulic chambers of the boom cylinder 4 and the arm cylinder 8 via either bottom-side lines 15 and 20 or rod-side lines 13 and 21. In addition, the fluid delivered from the hydraulic pump 1 is supplied from the control valve 5 or 9 to the bottom-side hydraulic chambers or the rod-side hydraulic chambers of the boom cylinder 4 and the arm cylinder 8 via either the bottom-side lines 15 and 20 or the rod-side lines 13 and 21, depending on changeover positions of the control valves 5 and 9. At least part of the hydraulic fluid discharged from the boom cylinder 4 is recirculated into a tank via the control valve 5 to a tank line 7*b*. Entirety of the hydraulic fluid discharged from the arm cylinder 8 is recirculated into the tank via the control valve 9 to a tank line 11*b*.

The first and second operation devices 6 and 10 have operation levers 6*a* and 10*a* and pilot valves 6*b* and 10*b*. The pilot valves 6*b* and 10*b* are connected to control sections 5*a* and 5*b* of the control valve 5 and operation sections 9*a* and 9*b* of the control valve 9 via pilot lines 6*c* and 6*d* and pilot lines 10*c* and 10*d*.

When the operation lever 6*a* is operated in a boom raising direction (leftward in FIG. 2), the pilot valve 6*b* generates an operation pilot pressure Pu in response to an operation amount of the operation lever 6*a*. This operation pilot pressure Pu is transmitted to the operation section 5*a* of the control valve 5 via the pilot line 6*c*, and a position of the control valve 5 is changed over to that in a boom raising direction (to a right position in FIG. 2). When the operation lever 6*a* is operated in a boom lowering direction (rightward in FIG. 2), the pilot valve 6*b* generates an operation pilot pressure Pd in response to an operation amount of the operation lever 6*a*. This operation pilot pressure Pd is transmitted to the operation section 5*b* of the control valve 5 via the pilot line 6*d*, and the position of the control valve 5 is changed over to that in a boom lowering direction (to a left position in FIG. 2).

When the operation lever 10*a* is operated in an arm crowding direction (rightward in FIG. 2), the pilot valve 10*b* generates an operation pilot pressure Pc in response to an operation amount of the operation lever 10*a*. This operation pilot pressure Pc is transmitted to the operation section 9*a* of the control valve 9 via the pilot line 10*c*, and a position of the control valve 9 is changed over to that in an arm crowding direction (to a left position in FIG. 2). When the operation lever 10*a* is operated in an arm dumping direction (leftward in FIG. 2), the pilot valve 10*b* generates an operation pilot pressure Pd in response to the operation amount of the operation lever 10*a*. This operation pilot pressure Pd is transmitted to the operation section 9*b* of the control valve 9 via the pilot line 10*d*, and the position of the control valve 9 is changed over to that in an arm dumping direction (to a right position in FIG. 2).

Overload relief valves 12 and 19 with makeup valves are connected between the bottom-side line 15 and the rod-side line 13 of the boom cylinder 4 and between the bottom-side line 20 and the rod-side line 21 of the arm cylinder 8, respectively. The overload relief valves 12 and 19 with the makeup valves function to prevent damage to hydraulic circuit devices due to excessive increase of pressures of the bottom-side lines 15 and 20 and the rod-side lines 13 and 21, and function to reduce occurrence of cavitation due to change of the pressures of the bottom-side lines 15 and 20 and the rod-side lines 13 and 21 to negative pressures.

Moreover, the hydraulic energy regeneration system according to the present embodiment includes a two-position, three-port reuse control valve 17 that is disposed in the bottom-side line 15 of the boom cylinder 4 and that can regulate a flow rate of the hydraulic fluid discharged from the bottom-side hydraulic chamber of the boom cylinder 4 to be distributed between a control valve 5-side (tank side) and a hydraulic fluid supply line 11*a*-side of the arm cylinder 8 (reuse line side), a reuse line 18 that has one end connected to one outlet port of the reuse control valve 17 and the other end connected to the hydraulic fluid supply line 11*a*, a communication line 14 that is branched off from the bottom-side line 15 and the rod-side line 13 of the boom cylinder 4 and that connects the bottom-side line 15 to the rod-side line 13, a communication pressure boost valve 16 that is disposed in the communication line 14, that is opened on the basis of the operation pilot pressure Pd for indicating the boom lowering direction (operation signal) generated in the first operation device 6 supplied via a solenoid proportional valve 28, that reuses and supplies part of the discharge fluid from the bottom-side hydraulic chamber of the boom cylinder 4 for and to the rod-side hydraulic chamber of the boom cylinder 4, and that can thereby boost a pressure of the bottom-side hydraulic chamber of the boom cylinder 4 up to twofold, solenoid proportional valves 22 and 28, pressure sensors 23, 24, 25, 26, and 29, and a controller 27.

The communication pressure boost valve 16 has an operation section 16*a*, and the operation pilot pressure Pd (operation signal) generated in the first operation device 6 for indicating the boom lowering direction is supplied to the operation section 16*a* via the solenoid proportional valve 28.

One solenoid proportional valve 28 controls a stroke of the communication pressure boost valve 16. The solenoid proportional valve 28 converts the operation pilot pressure Pd (operation signal) generated in the first operation device 6 for indicating the boom lowering direction BD into a desired pressure by changing its opening degree by a control signal from the controller 27.

A principle that the pressure of the bottom-side hydraulic chamber of the boom cylinder 4 is boosted up to twofold by causing the communication pressure boost valve 16 to act to be opened will now be explained.

A balance of power when the boom cylinder 4 is supporting the boom before and after the communication pressure boost valve 16 is opened will be considered. Parameters associated with the boom cylinder 4 in that case are represented by the following symbols.

Pb: Bottom-side pressure of boom cylinder 4 before opening of communication pressure boost valve 16

Pb': Bottom-side pressure of boom cylinder 4 after opening of communication pressure boost valve 16

Pr: Rod-side pressure of boom cylinder 4 before opening of communication pressure boost valve 16

Pr': Rod-side pressure of boom cylinder 4 after opening of communication pressure boost valve 16

Ab: Bottom-side pressure receiving area of boom cylinder 4

Ar: Rod-side pressure receiving area of boom cylinder 4

M: Mass acting on own weight direction of boom cylinder 4 g: Gravitational acceleration

The balance of power when no pressure acts on the rod side before the communication pressure boost valve 16 is opened is represented by the following Equation.

$$Mg=Ab\times Pb \tag{1}$$

The balance of power after the communication pressure boost valve 16 is opened is represented by the following Equation.

$$Mg+Ar\times Pr'=Ab\times Pb' \tag{2}$$

If it is supposed that there is no pressure loss in a state of fully opening the communication pressure boost valve 16, the following Equation is derived.

$$Pb'=Pr' \tag{3}$$

If Equations (1) and (3) are substituted into Equation (2) and Equation (2) is solved for Pb', the following Equation is derived.

$$Pb'=Ab/(Ab-Ar)\times Pb \tag{4}$$

Since the bottom-side pressure receiving area Ab is approximately twice as large as the rod-side pressure receiving area Ar for the normal boom cylinder, Ab/(Ab−Ar) is approximately 2. Therefore, the following Equation is derived from Equation (4).

$$Pb'=2\times Pb \tag{5}$$

Equation (5) shows that the bottom-side pressure of the boom cylinder 4 when the communication pressure boost valve 16 is opened is boosted up to twofold, compared with when the communication pressure boost valve 16 is closed. It is noted, however, that Equation (5) is established when it is supposed that there is no line loss in the communication pressure boost valve 16 and the line from the bottom-side line to the rod-side line of the boom cylinder 4, and a degree of pressure boosting can be regulated by throttling the communication pressure boost valve 16. A throttle amount is determined by an experiment or the like.

The reuse control valve 17 has a tank-side passage and a reuse-side passage so that the discharged fluid from the bottom side of the boom cylinder 4 can be circulated to a tank side (control valve 5-side) and a reuse line 18-side. The reuse control valve 17 has an operation section 17*a*, and a pilot pressure is supplied to the operation section 17*a* via the solenoid proportional valve 22. One solenoid proportional valve 22 controls a stroke of the reuse control valve 17. The solenoid proportional valve 22 converts a pressure of the hydraulic fluid supplied from the pilot pump 3 into a desired pilot pressure by changing its opening degree by a control signal from the controller 27.

The pressure sensor 23 is connected to the pilot line 6*d* and detects the operation pilot pressure Pd generated in the first operation device 6 for indicating the boom lowering direction. The pressure sensor 24 is connected to the pilot line 10*d* and detects the operation pilot pressure Pd generated in the second operation device 10 for indicating the arm dumping direction. In addition, the pressure sensor 25 is connected to the bottom-side line 15 of the boom cylinder 4 and detects the pressure of the bottom-side hydraulic chamber of the boom cylinder 4. The pressure sensor 26 is connected to the hydraulic fluid supply line 11*a* on the arm cylinder 8-side and detects the delivery pressure of the hydraulic pump 1. The pressure sensor 29 is connected to the rod-side line 13 of the boom cylinder 4 and detects a pressure of the rod-side hydraulic chamber of the boom cylinder 4.

Detection signals 123, 124, 125, 126, and 129 from the pressure sensors 23, 24, 25, 26, and 29 are inputted to the controller 27. The controller 27 performs predetermined computation on the basis of those signals and outputs control commands to the solenoid proportional valves 22 and 28 and the regulator 1*a*.

A principle that the pressure sensor 29 that detects the rod-side pressure of the boom cylinder 4 makes it possible to accurately grasp a load acting on the boom cylinder 4 even when the communication pressure boost valve 16 is controlled to be throttled will now be explained.

It is defined herein that the load acting on the boom cylinder 4 is a load pressure received only by the bottom-side pressure receiving area Ab of the boom cylinder 4. The following Equation is derived by modifying Equation (1) described above.

$$Pb=Mg/Ab \tag{6}$$

Equation (6) is established when no pressure acts on the rod side before the communication pressure boost valve 16 is opened. When the communication pressure boost valve 16 is opened and controlled to be throttled, Pb'≠Pr'. Therefore, the following Equation is derived by modifying Equation (2) and dividing both sides by Ab.

$$Mg/Ab=Pb'-Ar/Ab\times Pr' \tag{7}$$

The following Equation is derived by substituting Equation (6) into Equation (7).

$$Pb=Pb'-Ar/Ab\times Pr' \tag{8}$$

Equation (8) shows that the load pressure acting on the boom cylinder 4 can be calculated from the bottom-side pressure and the rod-side pressure. In the present embodiment, it is possible to exercise fine control in response to the load on the boom cylinder 4 since the pressure sensors 24 and 29 can detect the bottom-side pressure and the rod-side pressure.

An outline of an action when boom lowering is performed will next be explained.

In FIG. 2, when the operation lever 6*a* of the first operation device 6 is operated in the boom lowering direction, the operation pilot pressure Pd generated from the pilot valve 6*b* of the first operation device 6 is inputted to the control section 5*b* of the control valve 5 and inputted to the operation section 16*a* of the communication control valve 16 via the solenoid proportional valve 28. The position of the control valve 5 is thereby changed over to the left position in FIG. 2 to communicate the bottom line 15 with the tank line 7*b*. The hydraulic fluid is thereby discharged from the bottom-side hydraulic chamber of the boom cylinder 4, and a piston rod of the boom cylinder 4 performs a reduction action (boom lowering action).

Moreover, a position of the communication pressure boost valve 16 is changed over to a communication position on a lower side in FIG. 2, thereby reusing the hydraulic fluid from the bottom-side line 15 of the boom cylinder 4 to the rod-side line 13. This can boost the bottom-side pressure of the boom cylinder 4 and makes it unnecessary to supply the hydraulic fluid from the hydraulic pump 1. Therefore, output power of the hydraulic pump 1 can be suppressed and fuel economy can be enhanced.

An outline of an action when boom lowering and arm driving are simultaneously performed will next be explained. Since a principle is the same between a case of performing arm dumping and a case of performing arm crowding, the arm driving will be explained while taking an arm dumping action as an example.

The operation pilot pressure Pd generated from the pilot valve 10*b* of the second operation device 10 is inputted to the control section 9*b* of the control valve 9. The position of the control valve 9 is thereby changed over to communicate the bottom line 20 with the tank line 11*b* and communicate the bottom line 21 with the hydraulic fluid supply line 11*a*. The hydraulic fluid is thereby discharged from the bottom-side hydraulic chamber of the arm cylinder 8, and the delivered fluid from the hydraulic pump 1 is supplied to the rod-side hydraulic chamber of the arm cylinder 8. As a result, a piston rod of the arm cylinder 8 performs a reduction action.

The detection signals 123, 124, 125, 126, and 129 from the pressure sensors 23, 24, 25, 26, and 29 are inputted to the controller 27. The controller 27 outputs the control commands to the solenoid proportional valves 22 and 28 and the regulator 1*a* of the hydraulic pump 1 by a control logic to be described later.

The reuse control valve 17 is controlled by a pressure signal from the solenoid proportional valve 22, and the hydraulic fluid discharged from the bottom-side hydraulic chamber of the boom cylinder 4 is reused for the arm cylinder 8 via the reuse control valve 17.

The regulator 1*a* of the hydraulic pump 1 controls the tilting angle of the hydraulic pump 1 on the basis of the control command, and exercises control to reduce a pump flow rate in response to a reuse flow rate of the reuse control valve 17, thereby enhancing fuel economy.

The operation pilot pressure Pd generated from the pilot valve 6*b* of the first operation device 6 is inputted to the operation section 5*b* of the control valve 5 and inputted to the operation section 16*a* of the communication control valve 16 via the solenoid proportional valve 28. The control valve 5 and the communication pressure boost valve 16 are thereby changed over, and the hydraulic fluid discharged from the bottom-side hydraulic chamber of the boom cylinder 4 is reused. This can eliminate the need to supply the hydraulic fluid from the hydraulic pump 1 to the rod-side line 13 of the boom cylinder 4, so that it is possible to suppress unnecessary output power of the hydraulic pump 1 and effectively use a bottom flow rate of the boom cylinder 4. Furthermore, the pressure of the hydraulic fluid on the bottom side of the boom cylinder 4 is boosted up to twofold via the communication pressure boost valve 16, thereby facilitating reusing the hydraulic fluid from the boom for the arm.

As described above, the bottom-side pressure of the boom cylinder 4 can be boosted up to twofold by opening the communication pressure boost valve 16 during the boom lowering. Therefore, a frequency with which the bottom-side pressure of the boom cylinder 4 is higher than a pressure of the arm cylinder 8 increases. As a result, the reuse flow rate increases, so that fuel economy can be enhanced.

However, if the bottom-side pressure is boosted up to twofold when the high load acts on the boom cylinder 4, the bottom-side pressure possibly reaches an overload relief set pressure. In other words, there is a probability that the hydraulic fluid is discharged from the overload relief valve 12 to inadvertently lower the boom. To prevent this, it is necessary to close the communication pressure boost valve 16 when the bottom-side pressure gets closer to the overload relief set pressure. However, sudden valve closing causes a sudden change of a speed of the boom cylinder 4 to generate a shock.

According to the present embodiment, to prevent this, the opening degree of the communication pressure boost valve 16 is regulated by controlling the solenoid proportional valve 28 in response to the bottom-side pressure. This can prevent the pressure from reaching the overload relief set pressure and suppress a sudden pressure fluctuation, thereby ensuring favorable operability.

Figure 3:
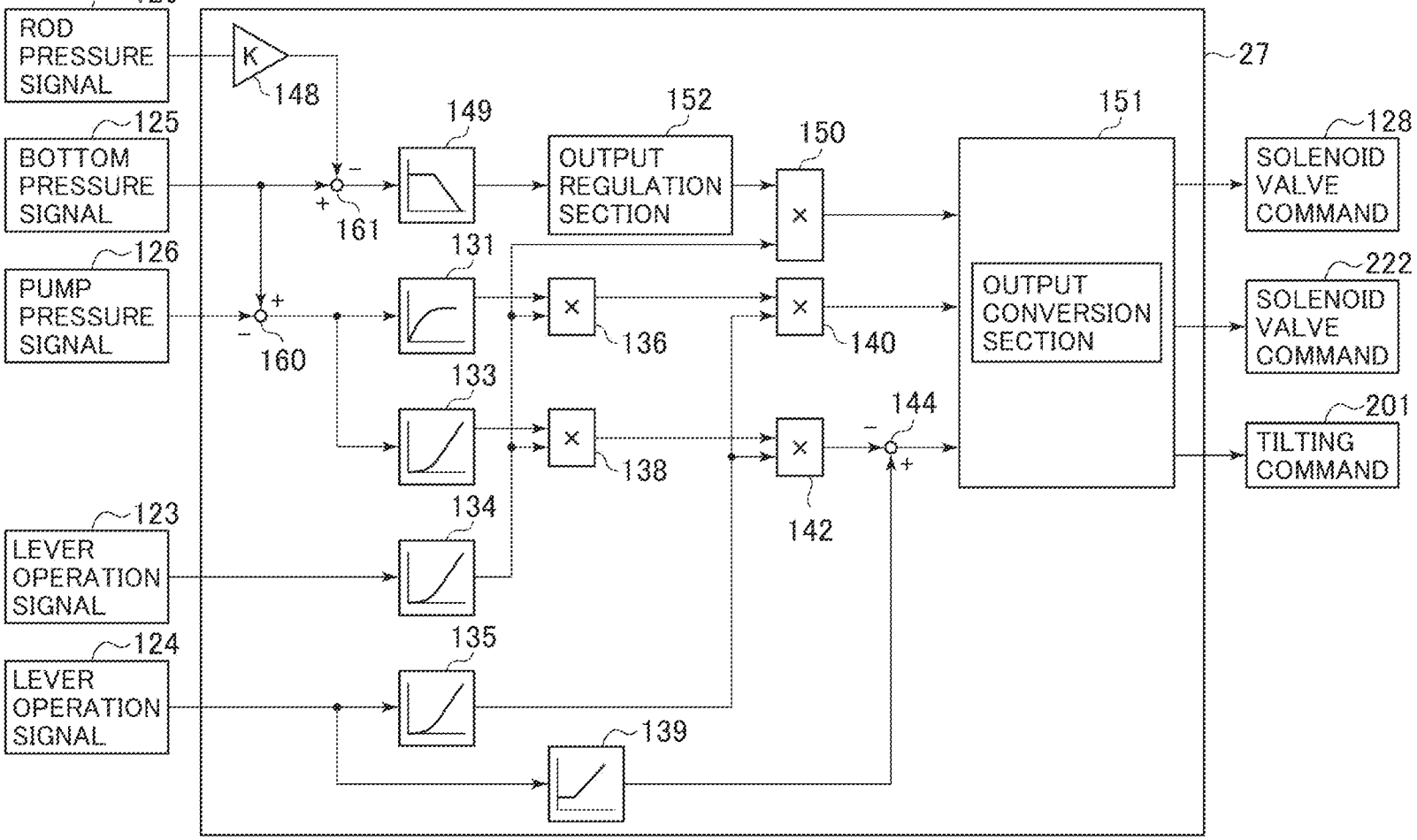
FIG. 3 is a block diagram of a controller that configures the first embodiment of the hydraulic energy regeneration system for the work machine according to the present invention.

A control function of the controller 27 will next be explained with reference to FIG. 3. FIG. 3 is a block diagram of the controller that configures the first embodiment of the hydraulic energy regeneration system for the work machine according to the present invention.

As shown in FIG. 3, the controller 27 has function generators 131, 133, 134, and 135, integrators 136 and 138, a function generator 139, integrators 140 and 142, a subtracter 144, a gain generator 148, an integrator 150, an output conversion section 151, an output regulation section 152, and subtracters 160 and 161.

In FIG. 3, the rod pressure signal 129 is a rod pressure of the boom cylinder 4 detected by the pressure sensor 29, the bottom pressure signal 125 is a bottom pressure of the boom cylinder 4 detected by the pressure sensor 25, and the pump pressure signal 126 is a delivery pressure of the hydraulic pump 1 detected by the pressure sensor 26. In addition, the lever operation signal 123 is a signal that indicates the operation pilot pressure generated in the first operation device 6 for indicating the boom lowering direction and that is detected by the pressure sensor 23, and the lever operation signal 124 is a signal that indicates the operation pilot pressure generated in the second operation device 10 for indicating the arm dumping direction and that is detected by the pressure sensor 24.

The lever operation signal 123 is inputted to the function generator 134, and an output signal (maximum: 1, minimum: 0) proportional to the input signal is inputted to the integrators 150, 136, and 138. Not only this signal but also a value (maximum: 1, minimum: 0) outputted from a function generator 149, to be described later, is inputted to the integrator 150 via the output regulation section 152.

Therefore, when an output from the function generator 149 is 1, an output from the integrator 150 is inputted to the output conversion section 151 as a same value as an output signal from the function generator 134, and is outputted to the solenoid proportional valve 28 by the output conversion section 151 as a solenoid valve command 128. In other words, when 1 is outputted to the integrator 150 from the function generator 149, the communication pressure boost valve 16 has an opening area proportional to the lever operation signal 123 indicating the boom lowering.

The rod pressure signal 129 is inputted to the gain generator 148. In the gain generator 148, Ar/Ab in Equation (8) described above, that is, a ratio of the rod-side pressure receiving area to the bottom-side pressure receiving area of the boom cylinder 4 is set, and an output signal obtained by multiplying this ratio by the rod pressure signal 129 is inputted to one side of the subtracter 161.

The bottom pressure signal 125 is inputted to the other side of the subtracter 161, and the subtracter 161 computes Equation (8). Therefore, an output signal from the subtracter 161 is a signal indicating the load pressure of the boom cylinder 4 and inputted to the function generator 149.

Figure 4:
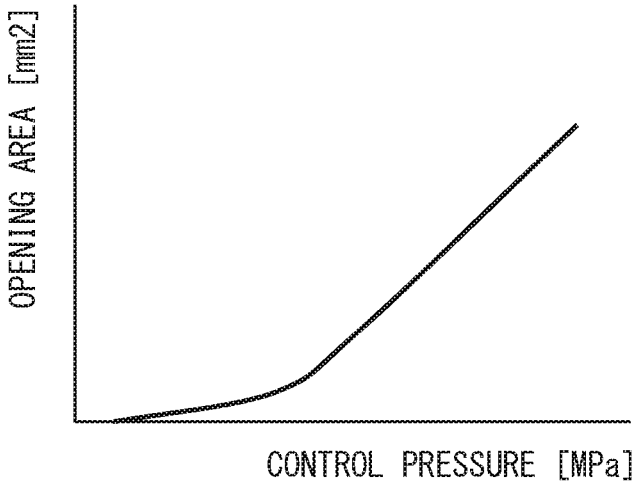
FIG. 4 is a characteristic diagram showing opening area characteristics of a communication pressure boost valve that configures the first embodiment of the hydraulic energy regeneration system for the work machine according to the present invention.
Figure 5:
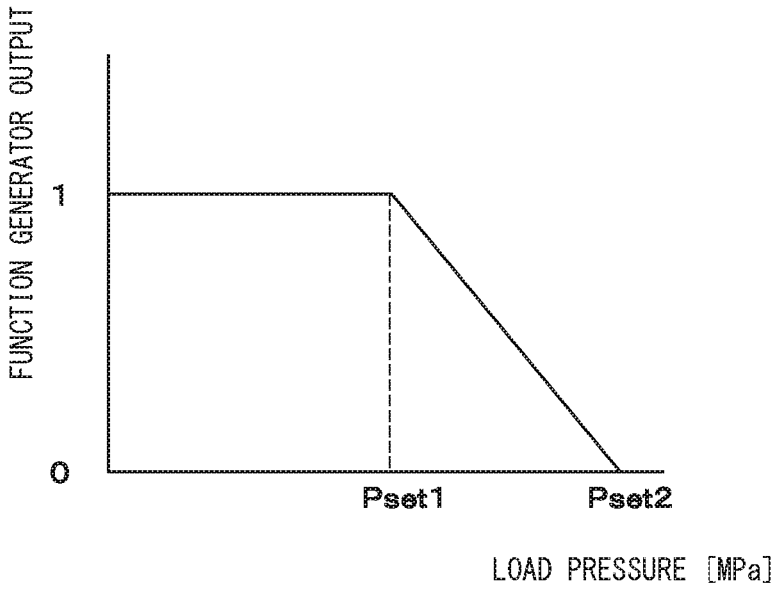
FIG. 5 is a characteristic diagram showing characteristics of a function generator 149 that configures the first embodiment of the hydraulic energy regeneration system for the work machine according to the present invention.

The function generator 149 computes any of continuous signals from 0 to 1 and outputs the computed signal to the output regulation section 152 in order to regulate the opening degree of the communication pressure boost valve 16 in response to a load pressure signal. A relationship between a control pressure to the communication pressure boost valve 16 and an opening area will now be explained with reference to FIGS. 4 and 5. FIG. 4 is a characteristic diagram showing opening area characteristics of the communication pressure boost valve that configures the first embodiment of the hydraulic energy regeneration system for the work machine according to the present invention. FIG. 5 is a characteristic diagram showing characteristics of the function generator 149 that configures the first embodiment of the hydraulic energy regeneration system for the work machine according to the present invention.

In FIG. 4, a horizontal axis indicates a control pressure outputted from the solenoid proportional valve 28, and a vertical axis indicates the opening area of the communication pressure boost valve 16. The opening area of the communication pressure boost valve 16 increases as the supplied control pressure increases.

FIG. 5 shows the characteristics of the function generator 149, a horizontal axis indicates the load pressure of the boom cylinder 4, and a vertical axis indicates an output signal having a maximum value of 1. In FIG. 5, the function generator 149 sets an output therefrom in such a manner as to output 1 when the load pressure is equal to or lower than Pset1, to gradually reduce the output as the load pressure increases over Pset1, and to output 0 when the load pressure is equal to or higher than Pset2. Pset2 shown in FIG. 5 is set to a value slightly lower than the overload relief set value, and Pset1 is set to a value lower than Pset2.

Because of this setting, when the load pressure is low, the function generator 149 outputs 1 and the opening area of the communication pressure boost valve 16, therefore, becomes proportional to the lever operation signal 123 indicating the boom lowering. The output from the function generator 149 becomes smaller than 1 as the load pressure is higher. Owing to this, the opening area of the communication pressure boost valve 16 is narrowed down. When the load pressure gets closer to the overload set pressure and the function generator 149 outputs 0, the communication pressure boost valve 16 is closed. In this way, it is possible to exercise finer control since the load pressure is calculated from the bottom pressure and the rod pressure of the boom cylinder 4 and the opening degree of the communication pressure boost valve 16 is corrected with respect to the overload set pressure on the basis of this load pressure. Furthermore, it is possible to exercise finer control and ensure favorable operability since the opening area of the communication pressure boost valve 16 can be regulated in response to the lever operation signal 123 that indicates the boom lowering operation amount.

While the hydraulic energy regeneration system is configured such that the load pressure is computed from the rod pressure signal and the bottom pressure signal and this load pressure is inputted to the function generator 149 in the present embodiment, the rod pressure signal is not necessarily used for the control. The hydraulic energy regeneration system may be configured, for example, such that the output from the bottom pressure signal 125 is inputted to the function generator 149 as an alternative to the load pressure.

Figure 6A:
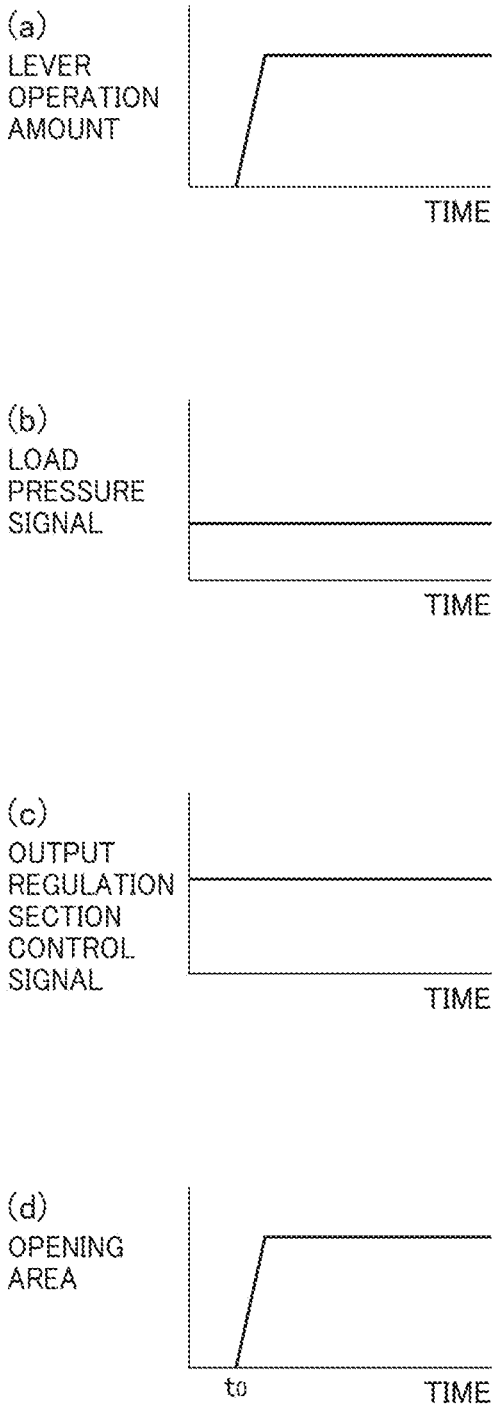
FIG. 6A is characteristic diagrams showing an example of control characteristics of the communication pressure boost valve that configures the first embodiment of the hydraulic energy regeneration system for the work machine according to the present invention.
Figure 6B:
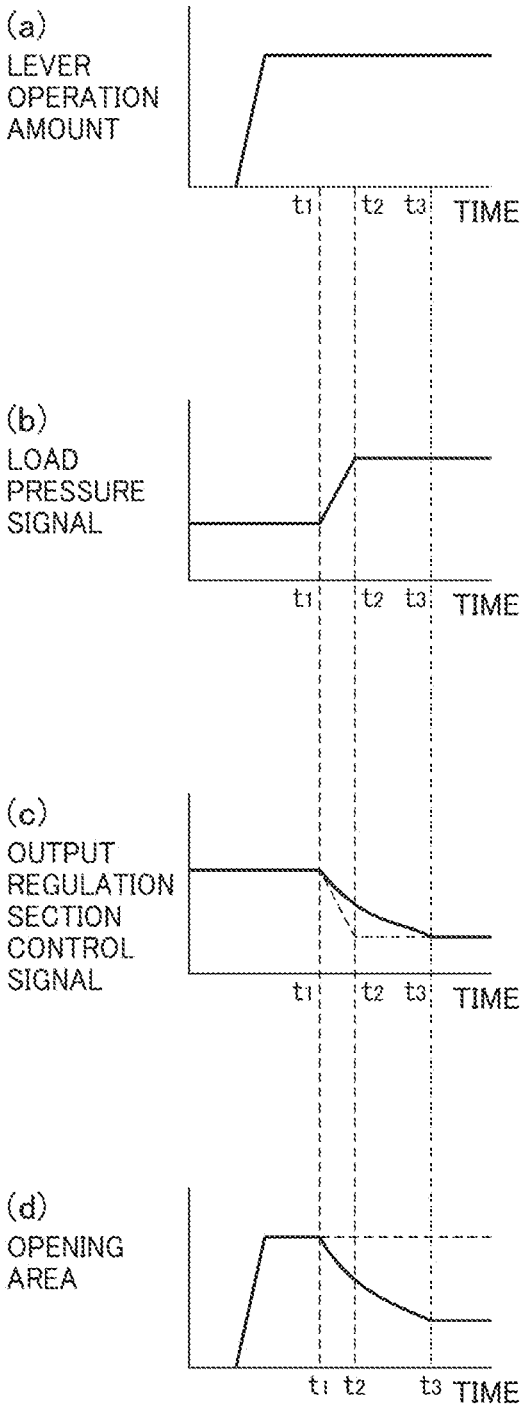
FIG. 6B is characteristic diagrams showing another example of control characteristics of the communication pressure boost valve that configures the first embodiment of the hydraulic energy regeneration system for the work machine according to the present invention.

Reference is made back to FIG. 3. The output signal from the function generator 149 is inputted to the output regulation section 152. The output regulation section 152 outputs a signal with an appropriate delay added to the integrator 150 for preventing a sudden changeover action of the communication pressure boost valve 16. An action of the output regulation section 152 will be explained with reference to FIGS. 6A and 6B. FIG. 6A is characteristic diagrams showing an example of control characteristics of the communication pressure boost valve that configures the first embodiment of the hydraulic energy regeneration system for the work machine according to the present invention. FIG. 6B is characteristic diagrams showing another example of control characteristics of the communication pressure boost valve that configures the first embodiment of the hydraulic energy regeneration system for the work machine according to the present invention.

FIG. 6A shows a behavior in response to a boom lowering operation when the load pressure is low, while FIG. 6B shows a behavior when the load pressure rises after the boom lowering operation. In FIGS. 6A and 6B, a horizontal axis indicates time, and a vertical axis indicates (a) a lever operation amount for the boom lowering, (b) the load pressure signal, (c) an output signal from the output regulation section 152, or (d) the opening area of the communication pressure boost valve 16. In (c), a solid line indicates the output signal from the output regulation section 152 and a chain line indicates the output signal from the function generator 149 that is the input signal to the output regulation section 152.

In FIG. 6A, the load pressure shown in (b) is lower than Pset1 of the function generator 149 and constant. Therefore, the output regulation section 152 continues to output the signal 1 shown in (c). Since the output from the integrator 150 is the lever operation signal 123 indicating the boom lowering, the opening area of the communication pressure boost valve 16 increases in response to the lever operation amount from time t0 at which the lever operation amount indicating the boom lowering shown in (a) increases.

FIG. 6B shows a case in which the load pressure rises. In FIG. 6B, when the load pressure shown in (b) rises from time t1 and becomes a constant value at time t2 while a constant value is inputted as the lever operation amount indicating the boom lowering as shown in (a), the output from the function generator 149 decreases in response to the load pressure and becomes a minimum value at the time t2 as indicated by the chain line as shown in (c).

When the output from the function generator 149 is inputted to the output regulation section 152, the input regulation section 152 adds the appropriate delay to the output. Therefore, the output therefrom gradually decreases from the time t1 and becomes the minimum value at time t3 as indicated by the solid line in (c). The output from the function generator 149 and the input regulation section 152 function to act in such a manner as to reduce the opening degree of the communication pressure boost valve 16 in response to an increase of the load pressure right after the load pressure reaches preset Pset1 and to gradually reduce the opening degree of the communication pressure boost valve 16 with passage of time. In this way, the output from the output regulation section 152 that is one of input signals to the integrator 150 changes while the other lever operation amount signal remains constant. The output from the integrator 150, therefore, changes in a similar fashion as that in (c). For this reason, the opening area of the communication pressure boost valve 16 is gradually narrowed down from the time t1 to the time t3 as shown in (d). This can suppress a speed change of the boom cylinder 4 and ensure favorable operability.

It is noted that the output regulation section 152 can be realized by a low-pass filter, a rate limiter, or the like. Furthermore, while the sudden change of the opening area of the communication pressure boost valve 16 is suppressed using the function generator 149 and the output regulation section 152 in the present embodiment, a way of suppression is not limited to using both the function generator 149 and the output regulation section 152. Either one of the function generator 149 and the output regulation section 152 may be used depending on a machine type of the work machine or an attachment attached to the front work implement 203.

Reference is made back to FIG. 3. The subtracter 160 inputs therein the bottom pressure signal 125 and the pump pressure signal 126, determines a differential pressure between the bottom pressure signal 125 and the pump pressure signal 126, and inputs a signal indicating this differential pressure to the function generators 131 and 133.

Figure 7:
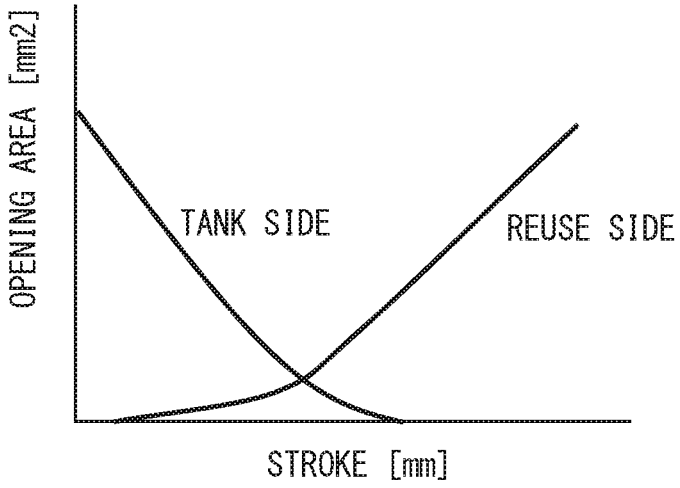
FIG. 7 is a characteristic diagram showing opening area characteristics of a reuse control valve that configures the first embodiment of the hydraulic energy regeneration system for the work machine according to the present invention.

The function generator 131 is used to calculate an opening area of the reuse-side passage of the reuse control valve 17 in response to the differential pressure signal determined by the subtracter 160. FIG. 7 shows opening area characteristics of the reuse control valve 17. FIG. 7 is a characteristic diagram showing the opening area characteristics of the reuse control valve that configures the first embodiment of the hydraulic energy regeneration system for the work machine according to the present invention.

In FIG. 7, a horizontal axis indicates a spool stroke of the reuse control valve 17 and a vertical axis indicates the opening area. When the spool stroke is minimum, the opening area is opened on the tank side and closed on the reuse-side and the hydraulic fluid is, therefore, not reused. When the stroke gradually increases, the opening area is closed on the tank side and opened on the reuse-side and the hydraulic fluid discharged from the bottom side of the boom cylinder 4, therefore, flows into the reuse line 18.

Reference is made back to FIG. 3, the function generator 131 outputs a command signal in response to the differential pressure signal outputted from the subtracter 160. Specifically, when the differential pressure is small, then the stroke of the reuse control valve 17 is set small, the opening area on the reuse-side is narrowed down, and the opening area on the tank side is enlarged. The reuse control valve 17 is controlled in such a manner that the opening of the reuse-side is set wide when the differential pressure is large, and that the opening on the reuse-side is set maximum and an opening on the tank side is closed when the differential pressure reaches a constant value. This control can suppress a changeover shock of the reuse control valve 17.

In other words, when the boom lowering operation and an arm operation are performed simultaneously, then the differential pressure is small at the start of motion and becomes larger with passage of time. Owing to this, gradually opening the opening area on the reuse-side in response to the differential pressure makes it possible to suppress the changeover shock and to realize favorable operability. Moreover, with the small differential pressure, the regeneration flow rate is low even if the opening on the reuse-side is set wide. Thus, a boom cylinder speed may slow down. Owing to this, when the differential pressure is small, control is exercised such that a bottom flow rate is increased by enlarging the tank-side opening area and the boom cylinder speed is set to an operator desired speed. When the differential pressure is large, the regeneration flow rate is sufficiently high. Owing to this, the boom cylinder speed is prevented from becoming excessively high by closing the tank side.

The function generator 133 is used to determine a reduced flow rate of the hydraulic pump 1 (hereinafter, referred to as pump reduced flow rate) in response to the differential pressure signal outputted from the subtracter 160. Since the function generator 131 has the characteristics that the opening area on the reuse-side is made larger as the differential pressure is larger, the reuse flow rate becomes larger. The flow rate of the hydraulic pump 1 is reduced as the reuse flow rate becomes larger, whereby it is possible to suppress output power from the hydraulic pump 1 and enhance fuel economy. Since the reuse flow rate becomes larger as the differential pressure is larger, the pump reduced flow rate is also set to become larger.

The integrator 136 inputs therein the opening area on the reuse-side calculated by the function generator 131 and a value calculated by the function generator 134, and outputs an integration value as an opening area. Here, when the lever operation signal 123 of the first operation device 6 is small, it is necessary to slow down the boom cylinder speed and, therefore, necessary to reduce the reuse flow rate. Owing to this, the function generator 134 outputs a small value in a range equal to or greater than 0 and equal to or smaller than 1 and sends the value to the integrator 136, thereby setting small the opening area on the reuse-side calculated by the function generator 131.

The same thing is true for the pump reduced flow rate. When the reuse flow rate is small, it is necessary to set small the pump reduced flow rate. Owing to this, an output from the function generator 134 is also sent to the integrator 138, thereby setting the pump reduced flow rate to be reduced. The integrator 138 inputs therein the pump reduced flow rate calculated by the function generator 133 and the value calculated by the function generator 134, and outputs an integration value as a pump reduced flow rate.

On the other hand, when the lever operation signal 123 of the first operation device 6 is large, it is necessary to gain the boom cylinder speed and, therefore, the reuse flow rate can be increased. Owing to this, the function generator 134 outputs a large value in a range equal to or greater than 0 and equal to or smaller than 1 and sends the value to the integrator 136, thereby setting large the opening area on the reuse-side calculated by the function generator 131.

The same thing is true for the pump reduced flow rate. When the reuse flow rate is large, it is necessary to set large the pump reduced flow rate. Owing to this, the output from the function generator 134 is also sent to the integrator 138, thereby setting the pump reduced flow rate to be increased.

The lever operation signal 124 of the second operation device 10 is inputted to the function generator 135, and an output signal (maximum: 1, minimum: 0) proportional to the input signal is inputted to the integrators 140 and 142. When the lever operation signal 124 of the second operation device 10 is small, it is necessary to slow down the arm cylinder speed and, therefore, necessary to reduce the reuse flow rate. Owing to this, the function generator 135 outputs a small value in a range equal to or greater than 0 and equal to or smaller than 1 and sends the value to the integrator 140, thereby setting small the opening area on the reuse-side calculated by the function generator 131.

The same thing is true for the pump reduced flow rate. When the reuse flow rate is small, it is necessary to set small the pump reduced flow rate. Owing to this, an output from the function generator 135 is also sent to the integrator 142, thereby setting the pump reduced flow rate to be reduced.

On the other hand, when the lever operation signal 124 of the second operation device 10 is large, it is necessary to gain the arm cylinder speed and, therefore, the reuse flow rate can be increased. Owing to this, the function generator 135 outputs a large value in a range equal to or greater than 0 and equal to or smaller than 1 and sends the value to the integrator 140, thereby setting large the opening area on the reuse-side calculated by the function generator 131.

The same thing is true for the pump reduced flow rate. When the reuse flow rate is large, it is necessary to set large the pump reduced flow rate. Owing to this, the output from the function generator 135 is also sent to the integrator 142, thereby setting the pump reduced flow rate to be increased.

It is desirable to regulate tables of the function generators 131, 133, 134, and 135 and the opening area characteristics of the reuse control valve so that the boom cylinder speed does not greatly change whether or not the bottom-side discharged fluid from the boom cylinder 4 is reused. The action of reusing the hydraulic fluid of the boom cylinder 4 for the arm cylinder 8, in particular, is mainly a leveling action. Owing to this, the bottom pressure of the boom cylinder 4 and the rod pressure of the arm cylinder 8 in that case tend to be fixed to some extent. Therefore, analyzing a pressure waveform during the leveling action makes it possible to set the opening area of the reuse control valve 17 to an optimum value to some extent.

The function generator 139 is used to calculate a required pump flow rate in response to the lever operation signal 124 of the second operation device 10. The function generator 139 has characteristics that when the lever operation signal 124 is not inputted, a minimum flow rate is outputted from the hydraulic pump 1. This is intended to improve responsiveness when the operation lever of the second operation device 10 is activated and to prevent seizure of the hydraulic pump 1. When the lever operation signal 124 increases, then the delivery flow rate of the hydraulic pump 1 is increased and the hydraulic fluid flowing into the arm cylinder 8 is increased. An arm cylinder speed in response to the operation amount is thereby realized.

The subtracter 144 inputs therein the pump reduced flow rate outputted from the integrator 142 and the required flow rate calculated by the function generator 139. The subtracter 144 subtracts the pump reduced flow rate, that is, the reuse flow rate from the required flow rate, whereby it is possible to suppress pump output power and enhance fuel economy.

The output conversion section 151 inputs therein outputs from the integrator 140 and the subtracter 144, and outputs the outputs as a solenoid valve command 222 to the solenoid proportional valve 22 and a tilting command 201 to the hydraulic pump 1, respectively.

The solenoid proportional valve 22 is thereby controlled, so that a drive pressure outputted from the solenoid proportional valve 22 controls the opening area of the reuse control valve 17 to a desired opening area. In addition, the tilting command 201 controls tilting of the hydraulic pump 1 to desired tilting, so that the hydraulic pump 1 delivers a pump flow rate from which the reuse flow rate is reduced.

Next, operation of the controller 27 will be explained. The function generator 134 inputs therein the lever operation signal 123, and outputs a signal proportional to the lever operation signal 123. The output from the function generator 134 as well as the signal outputted from the function generator 149 via the output regulation section 152 is inputted to the integrator 150. The output from the integrator 150 is outputted to the solenoid proportional valve 28 as the solenoid valve command 128 via the output conversion section 151.

When the load pressure is low, the function generator 149 outputs 1. The opening area of the communication pressure boost valve 16, therefore, becomes proportional to the lever operation signal 123. As the load pressure gets higher, the output from the function generator 149 becomes smaller than 1 and the opening of the communication pressure boost valve 16 is, therefore, narrowed down. When the load pressure gets closer to the overload relief set pressure and the function generator 149 outputs 0, the communication pressure boost valve 16 is closed.

When the differential pressure signal is inputted to the function generators 131 and 133 from the subtracter 160, the function generators 131 and 133 output the signal indicating the opening area on the reuse-side of the reuse control valve 17 and the signal indicating the pump reduced flow rate, respectively. When the lever operation signal 123 is inputted to the function generator 134, then the function generator 134 outputs the value in response to the lever operation amount to the integrators 136 and 138 to correct the reuse-side opening area signal outputted from the function generator 131 and the pump reduced flow rate signal outputted from the function generator 133.

Likewise, when the lever operation signal 124 is inputted to the function generator 135, the function generator 135 outputs the value in response to the lever operation amount to the integrators 140 and 142 to correct the reuse-side opening area signal outputted from the function generator 136 and the pump reduced flow rate signal outputted from the function generator 138.

The function generator 139 outputs the required flow rate of the hydraulic pump 1 in response to the lever operation signal 124 and sends the required flow rate to the subtracter 144. The subtracter 144 outputs a signal obtained by subtracting the pump reduced flow rate, that is, the reuse flow rate from the required flow rate, to the output conversion section 151.

The output conversion section 151 inputs therein the signals from the integrator 14 and the subtracter 144, and outputs the signals as the solenoid valve command 222 to the solenoid proportional valve 22 and the tilting command 201 to the hydraulic pump 1, respectively. The solenoid proportional valve 22 is thereby controlled, so that the drive pressure outputted from the solenoid proportional valve 22 controls the opening area of the reuse control valve 17 to the desired opening area. In addition, the tilting command 201 controls the tilting of the hydraulic pump 1 to the desired tilting, so that the hydraulic pump 1 delivers the pump flow rate from which the reuse flow rate is reduced.

Through the actions described so far, it is possible to regulate the opening area of the communication pressure boost valve 16 in response to the load pressure and the lever operation signal 123 that indicates the boom lowering operation amount. It is, therefore, possible to exercise finer control and ensure favorable operability. Furthermore, even if the load pressure suddenly rises, a control amount is outputted from the solenoid proportional valve 28 with the appropriate delay. It is, therefore, possible to suppress a sudden changeover of the communication pressure boost valve 16. Moreover, controlling the reuse control valve 17 and the hydraulic pump 1 in response to the differential pressure and the lever operation amount makes it possible to enhance fuel economy and ensure favorable operability.

According to the first embodiment of the hydraulic energy regeneration system for the work machine according to the present invention, it is possible to prevent the bottom pressure of the boom cylinder 4 from reaching the overload relief set pressure and to suppress the changeover shock to ensure favorable operability even if the high load acts on the boom cylinder 4.

Moreover, according to the first embodiment of the hydraulic energy regeneration system for the work machine according to the present invention, it is possible to exercise finer control since the load pressure is calculated from the bottom pressure and the rod pressure of the boom cylinder 4 and the opening degree of the communication pressure boost valve 16 is corrected with respect to the overload set pressure on the basis of this load pressure. Furthermore, it is possible to exercise finer control and ensure favorable operability since the opening area of the communication pressure boost valve 16 can be regulated in response to the lever operation signal 123 that indicates the boom lowering operation amount.

While the hydraulic energy regeneration system is configured such that the load pressure is computed from the rod pressure signal and the bottom pressure signal and this load pressure is inputted to the function generator 149 in the present embodiment, the rod pressure signal is not necessarily used for the control. The hydraulic energy regeneration system may be configured, for example, such that the output from the bottom pressure signal 125 is inputted to the function generator 149 as an alternative to the load pressure.

Second Embodiment

Figure 8:
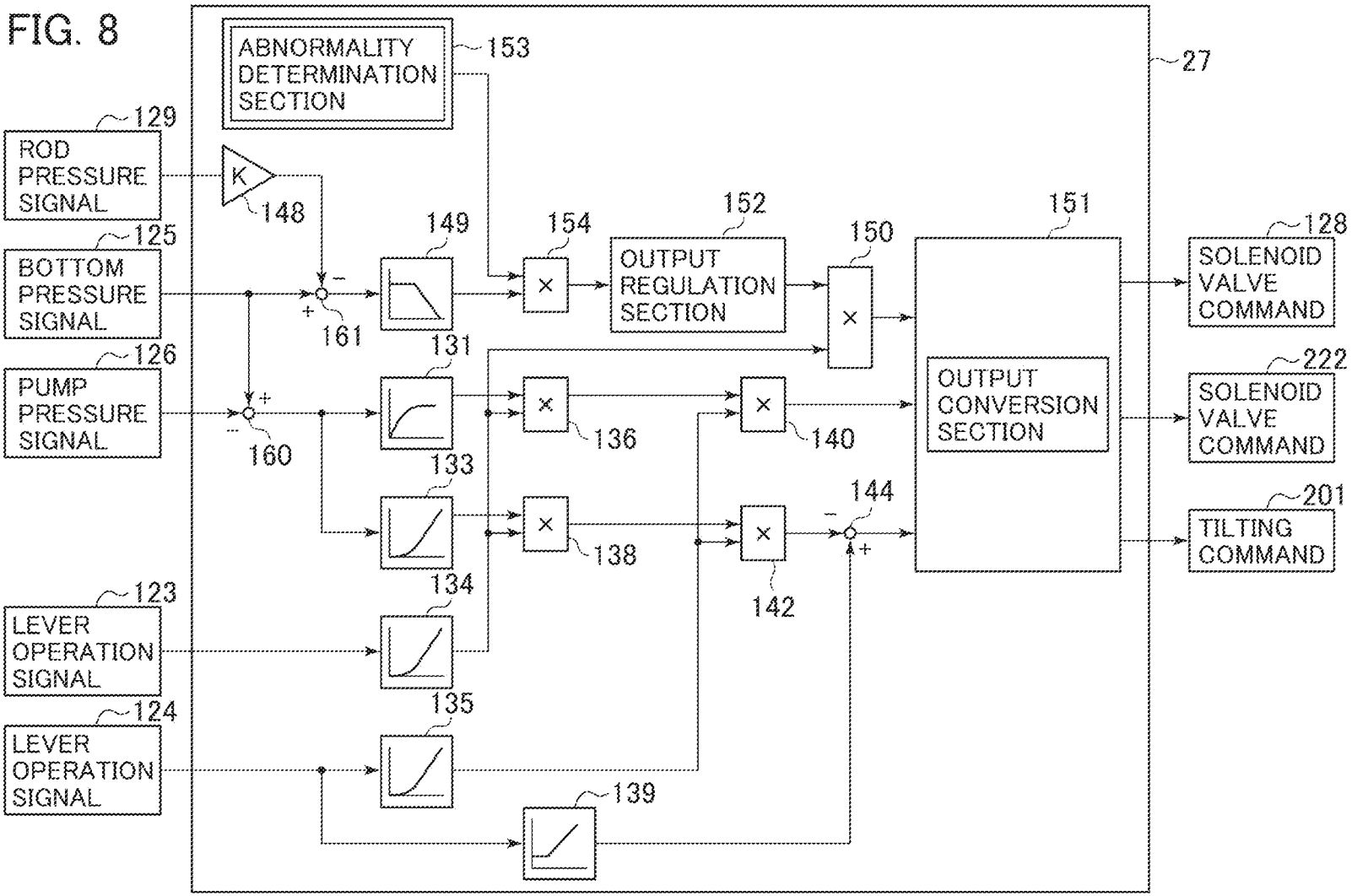
FIG. 8 is a block diagram of a controller that configures a second embodiment of the hydraulic energy regeneration system for the work machine according to the present invention.
Figure 9:
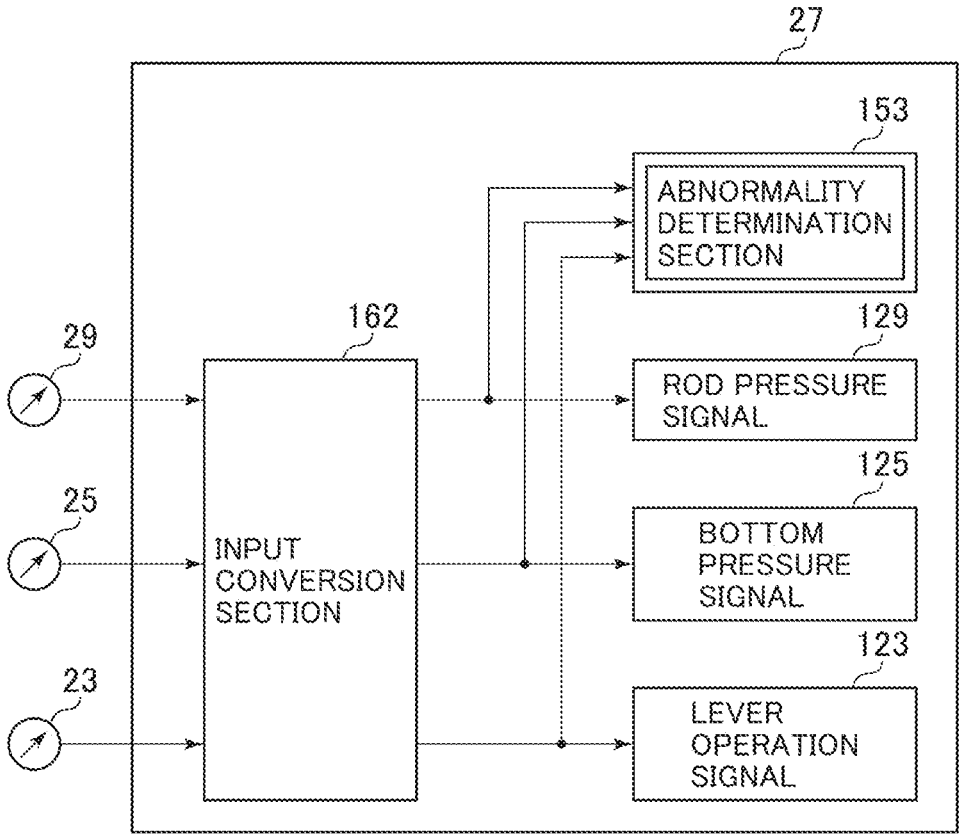
FIG. 9 is a block diagram explaining an input section of a controller that configures the second embodiment of the hydraulic energy regeneration system for the work machine according to the present invention.
Figure 10:
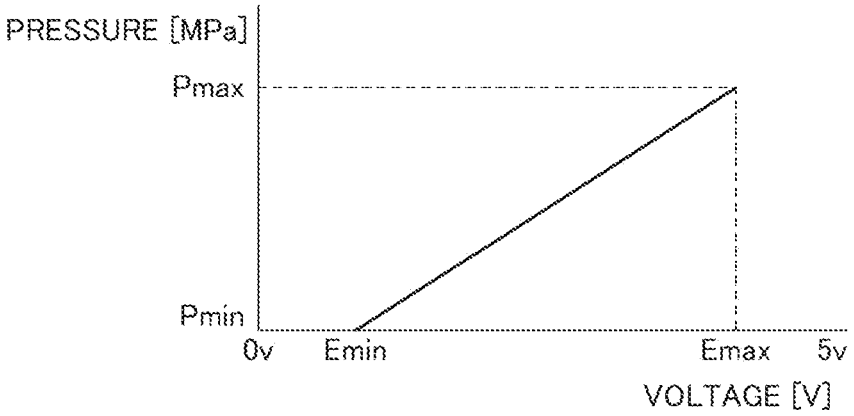
FIG. 10 is a characteristic diagram showing characteristics of an input conversion section of the controller that configures the second embodiment of the hydraulic energy regeneration system for the work machine according to the present invention.

A second embodiment of the hydraulic energy regeneration system for the work machine according to the present invention will be described hereinafter with reference to the drawings. FIG. 8 is a block diagram of a controller that configures the second embodiment of the hydraulic energy regeneration system for the work machine according to the present invention. FIG. 9 is a block diagram explaining an input section of the controller that configures the second embodiment of the hydraulic energy regeneration system for the work machine according to the present invention. FIG. 10 is a characteristic diagram showing characteristics of an input conversion section of the controller that configures the second embodiment of the hydraulic energy regeneration system for the work machine according to the present invention. In FIGS. 8 to 10, constituent elements denoted by the same reference characters as those shown in FIGS. 1 to 7 are the same as those in FIGS. 1 to 7; detailed explanation thereof will be omitted.

The second embodiment of the hydraulic energy regeneration system for the work machine according to the present invention differs from the first embodiment in that the controller 27 includes an abnormality determination section 153 as shown in FIG. 8. Specifically, an integrator 154 is provided between the function generator 149 and the output regulation section 152, an output signal from the abnormality determination section is inputted to one end of the integrator 154, the output signal from the function generator 149 is inputted to the other end of the integrator 154, and an output signal from the integrator 154 is inputted to the output regulation section 152.

In the first embodiment, the opening area of the communication pressure boost valve 16 is controlled on the basis of the detection signals including the bottom pressure signal 125, the rod pressure signal 129, and the lever operation signal 123. However, when any of the pressure sensors 23, 25, and 29 that detect these signals fails, there is a probability that the communication pressure boost valve 16 cannot be controlled appropriately.

It is supposed, for example, that an abnormality occurs to the pressure sensor 25 and the pressure sensor 25 outputs the bottom pressure of the boom cylinder 4 at a value lower than an actual value. When the load pressure rises and the bottom pressure gets closer to the overload relief set pressure in this state, the bottom pressure signal 125 is outputted at the value lower than the actual value. Owing to this, the communication pressure boost valve 16 is not closed; at worst, the hydraulic fluid flows from the overload relief valve 12 and the boom cylinder 4 inadvertently falls.

In the present embodiment, to prevent occurrence of such an event, the controller 27 exercises control in such a manner as to determine an abnormality and to appropriately close the communication pressure boost valve 16 when the abnormality occurs to each pressure sensor. A method of determining the abnormality in each pressure sensor by the abnormality determination section 153 will be explained below.

FIG. 9 is a block diagram explaining the input section of the controller 27. The controller 27 includes an input conversion section 162 to which an electrical signal is inputted from each pressure sensor and which converts the electrical signal into a pressure signal. The rod pressure signal 129, the bottom pressure signal 125, and the lever operation signal 123 obtained by conversion in the input conversion section 162 are used for computation of the control logic. While the other pressure signals that are not shown are also inputted to the input determination section 162, the other pressure signals are omitted herein.

A function of the input conversion section 162 will be explained with reference to FIG. 10. In FIG. 10, a horizontal axis indicates a voltage that is the electrical signal inputted to the input conversion section 162, and a vertical axis indicates the pressure signal obtained by the conversion. Pmin indicates a minimum measurable pressure determined by specifications of the pressure sensors, and Pmax indicates a maximum measurable pressure determined by the specifications of the pressure sensors. Emin and Emax are voltage values at Pmin and Pmax, respectively. Emin is the value higher than 0 V that is a minimum voltage, and Emax is the value lower than 5 V that is a maximum voltage. In other words, when each pressure sensor operates normally, the value of the voltage outputted from the pressure sensor is between Emin and Emax.

Electrical signals outputted from the pressure signals 129, 125, and 123 are inputted to the abnormality determination section 153. Here, if a harness of each pressure sensor is broken or short-circuited, the voltage of the electrical signal inputted from the pressure sensor to the controller 27 is 0 V in a case of breaking and around 5 V in a case of short-circuit. The abnormality determination section 153, therefore, monitors the electrical signal from each of the pressure sensors and determines that any of the pressure sensors is abnormal when the electrical signal from the pressure sensor has a voltage value that deviates from either Emin or Emax and that is close to 0 V or 5 V.

Reference is made back to FIG. 8. The abnormality determination section 153 sends, to the integrator 154, 1 when determining that each pressure sensor is normal and 0 when determining that any of the pressure sensors is abnormal. Since 1 is outputted when the abnormality determination section 153 determines that each pressure sensor is normal, the output from the function generator 149 is outputted from the integrator 154 as it is. When the abnormality determination section 153 determines that any of the pressure sensors is abnormal, 0 is inputted to the integrator 154 and yet outputted from the integrator 150; the communication pressure boost valve 16 is finally controlled to be closed.

In other words, when the abnormality determination section 153 determines that any one of the pressure sensors is abnormal, then the abnormality determination section 153 outputs a signal 0, and the controller 27 exercises control to close the communication pressure boost valve 16 irrespective of the load pressure and the lever operation amount.

Since the abnormality determination section 153 outputs a signal by ON-and-OFF output, the abnormality determination section 153 is configured to be connected forward of the output regulation section 152 that adds a delay to the signal. Owing to this, when the abnormality determination section 153 determines that any of the pressure sensors is in an abnormal state, the output regulation section 152 acts in such a manner as to gradually reduce the opening degree of the communication pressure boost valve 16 with passage of time. When a shock could be generated only by addition of the delay by the output regulation section 152, a second output regulation section may be provided between the abnormality determination section 153 and the integrator 154 for adding a further delay to the signal.

The second embodiment of the hydraulic energy regeneration system for the work machine according to the present invention described above can attain similar effects to those of the first embodiment.

Moreover, even if an abnormality occurs to each pressure sensor, the second embodiment of the hydraulic energy regeneration system for the work machine according to the present invention described above can appropriately close the communication pressure boost valve 16, prevent the bottom pressure from reaching the overload relief set pressure, and ensure favorable operability without the changeover shock.

Third Embodiment

Figure 11:
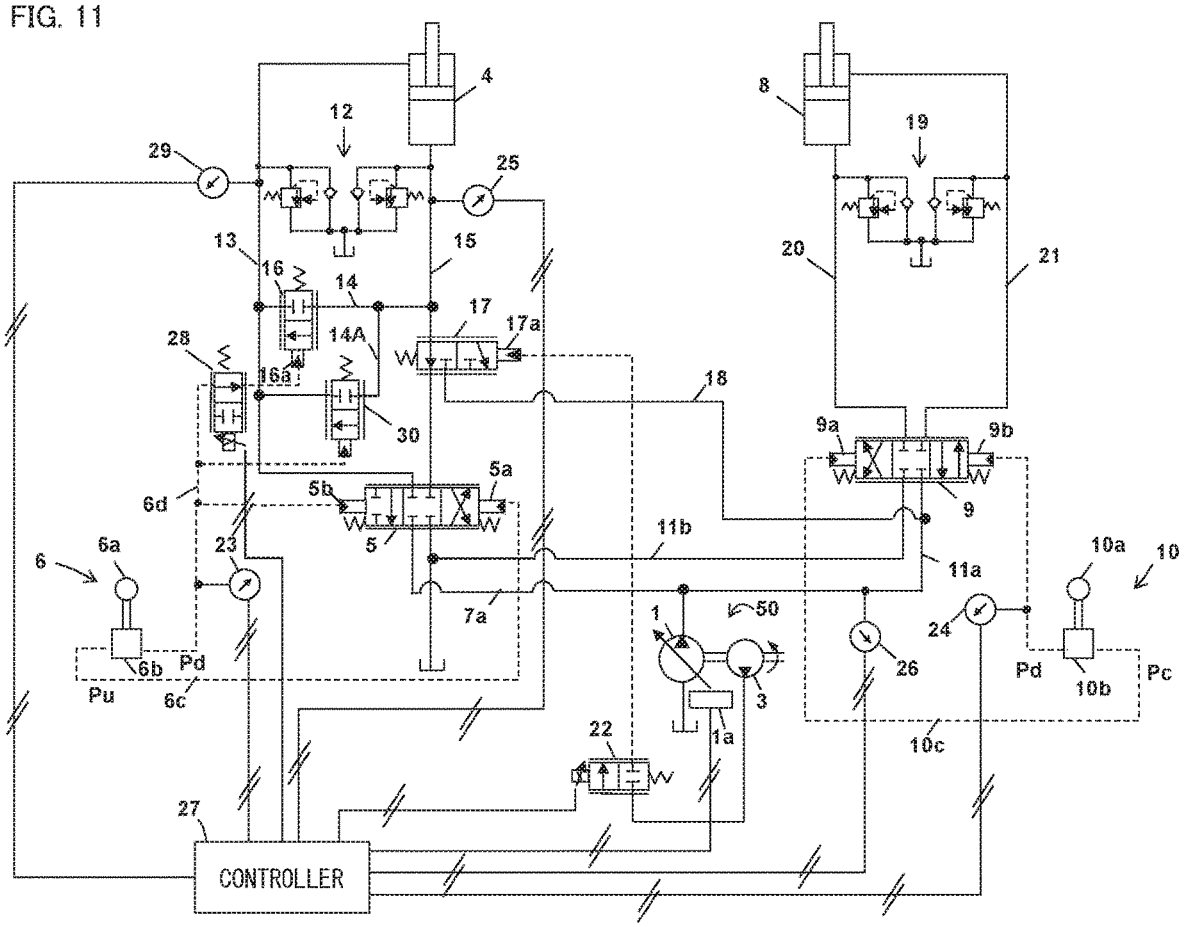
FIG. 11 is a schematic diagram showing a third embodiment of the hydraulic energy regeneration system for the work machine according to the present invention.

A third embodiment of the hydraulic energy regeneration system for the work machine according to the present invention will be described hereinafter with reference to the drawings. FIG. 11 is a schematic diagram showing the third embodiment of the hydraulic energy regeneration system for the work machine according to the present invention. In FIG. 11, constituent elements denoted by the same reference characters as those shown in FIGS. 1 to 10 are the same as those in FIGS. 1 to 10; detailed explanation thereof will be omitted.

As shown in FIG. 11, the third embodiment of the hydraulic energy regeneration system for the work machine according to the present invention differs from the first embodiment by providing a second communication line 14A that is disposed in parallel to the communication line 14 and that serves as a second communication pressure boost passage connecting the bottom-side line 15 to the rod-side line 13, and by providing a control valve 30 that is disposed in the second communication line 14A and that serves as a second communication pressure boost valve reusing a return hydraulic fluid flowing from the bottom-side line 15 in the rod-side line 13 during the boom lowering operation.

In FIG. 11, when the boom lowering operation is performed, the pilot pressure Pd acts on the control valve 30. The return hydraulic fluid discharged from the bottom side of the boom cylinder 4 thereby flows into the control valve 30 through the bottom-side line 15 to be throttle-controlled, passes through the rod-side line 13, merges with the reuse flow in the communication pressure boost valve 16, and is regenerated on the rod side of the boom cylinder 4.

According to the present embodiment, such a configuration can suppress the sudden pressure change since the hydraulic fluid flows from the passage of the control valve 30 to the rod side even when an abnormality occurs to the solenoid proportional valve 28 to inadvertently close the communication pressure boost valve 16. It is thereby possible to reduce the shock and reduce the occurrence of cavitation due to the negative pressure.

The third embodiment of the hydraulic energy regeneration system for the work machine according to the present invention described above can attain similar effects to those of the first embodiment.

Furthermore, according to the third embodiment of the hydraulic energy recovery system for the work machine according to the present invention, the reuse passage other than the communication pressure boost valve 16 is provided. It is, therefore, possible to reduce the shock and prevent the cavitation even when the communication pressure boost valve 16 is inadvertently closed due to an electrical failure.

Fourth Embodiment

Figure 12:
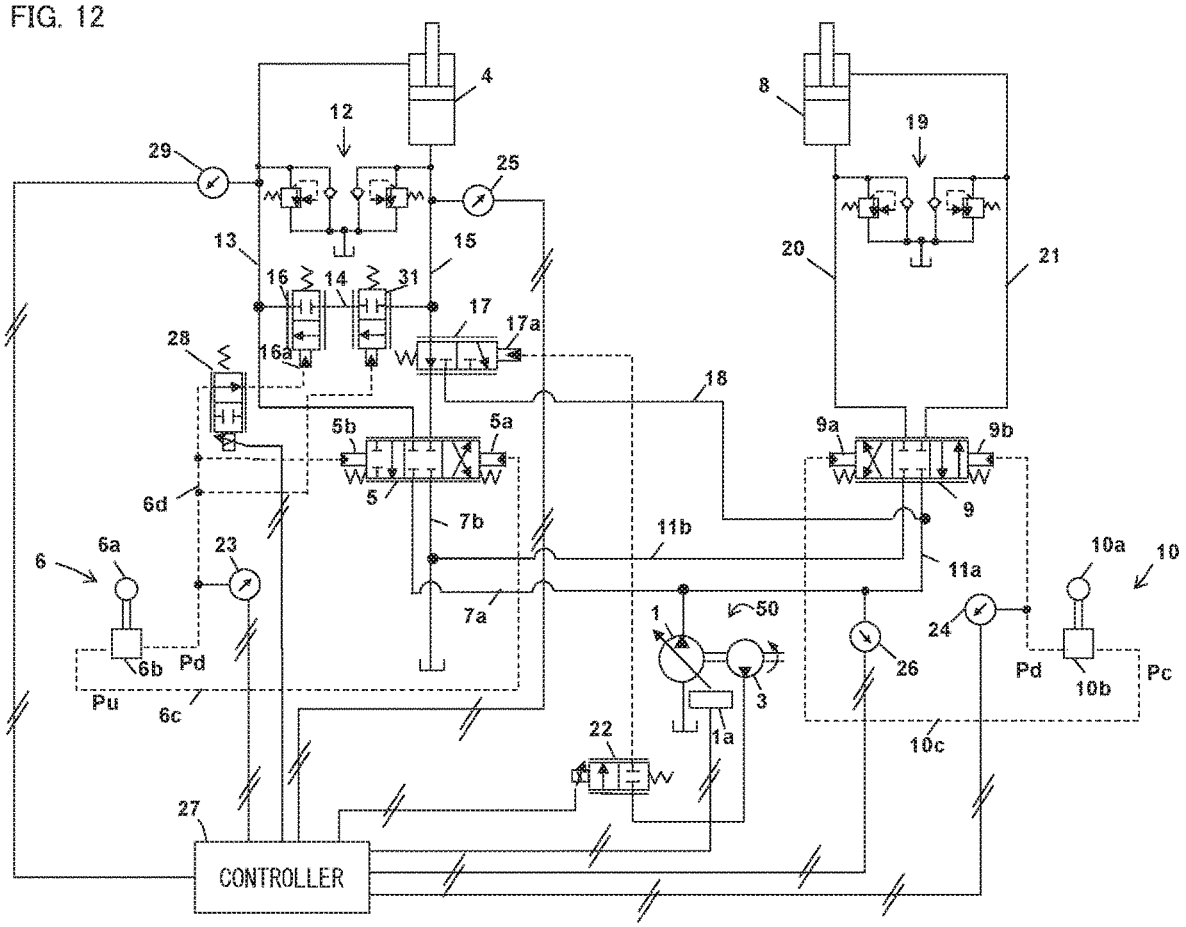
FIG. 12 is a schematic diagram showing a fourth embodiment of the hydraulic energy regeneration system for the work machine according to the present invention.

A fourth embodiment of the hydraulic energy regeneration system for the work machine according to the present invention will be described hereinafter with reference to the drawings. FIG. 12 is a schematic diagram showing the fourth embodiment of the hydraulic energy regeneration system for the work machine according to the present invention. In FIG. 12, constituent elements denoted by the same reference characters as those shown in FIGS. 1 to 11 are the same as those in FIGS. 1 to 11; detailed explanation thereof will be omitted.

The fourth embodiment of the hydraulic energy regeneration system for the work machine according to the present invention differs from the first embodiment in that a control valve 31 is provided on the communication line as shown in FIG. 12.

In FIG. 12, when the boom lowering operation is performed, the pilot pressure Pd acts on the control valve 31. The return hydraulic fluid discharged from the bottom side of the boom cylinder 4 thereby flows into the control valve 31 through the bottom-side line 15 to be throttle-controlled, and is then fed to the communication pressure boost valve 16.

According to the present embodiment, such a configuration can suppress the pressure boosting since the regeneration passage of the control valve 31 can be throttled by operating the operation lever 6 in a direction of returning the operation lever 6*a* to reduce the pilot pressure Pd even when the communication pressure boost valve 16 becomes disabled in a state of being suck open. Owing to this, even when the high load acts on the boom cylinder 4 to make the bottom pressure closer to the overload relief set pressure and the communication pressure boost valve 16 is disabled, the control valve 31 can throttle the regeneration passage. Therefore, it is possible to suppress the pressure boosting and prevent the bottom pressure from inadvertently reaching the overload relief set pressure.

The fourth embodiment of the hydraulic energy regeneration system for the work machine according to the present invention described above can attain similar effects to those of the first embodiment.

According to the fourth embodiment of the hydraulic energy recovery system for the work machine according to the present invention, another regeneration throttle is provided upstream of the communication pressure boost valve 16. It is, therefore, possible to suppress the pressure boosting and prevent the bottom pressure from reaching the overload relief set pressure even when the communication pressure boost valve 16 inadvertently remains opened and disabled.

According to the present embodiment, even if the hydraulic energy regeneration system for the work machine is configured such that the pressure inputted to the solenoid proportional valve 28 is not the pilot pressure Pd but, for example, a pressure of the pilot pump 3, and the pressure is reduced in the solenoid proportional valve 28, the regeneration passage of the control valve 31 is throttled and the pressure boosting can be suppressed by operating the operation lever 6 in the direction of returning the operation lever 6*a* to reduce the pilot pressure Pd. In other words, even when the communication pressure boost valve 16 remains opened due to an electrical failure, it is possible to suppress the pressure boosting and prevent the bottom pressure from reaching the overload relief set pressure.

Fifth Embodiment

Figure 13:
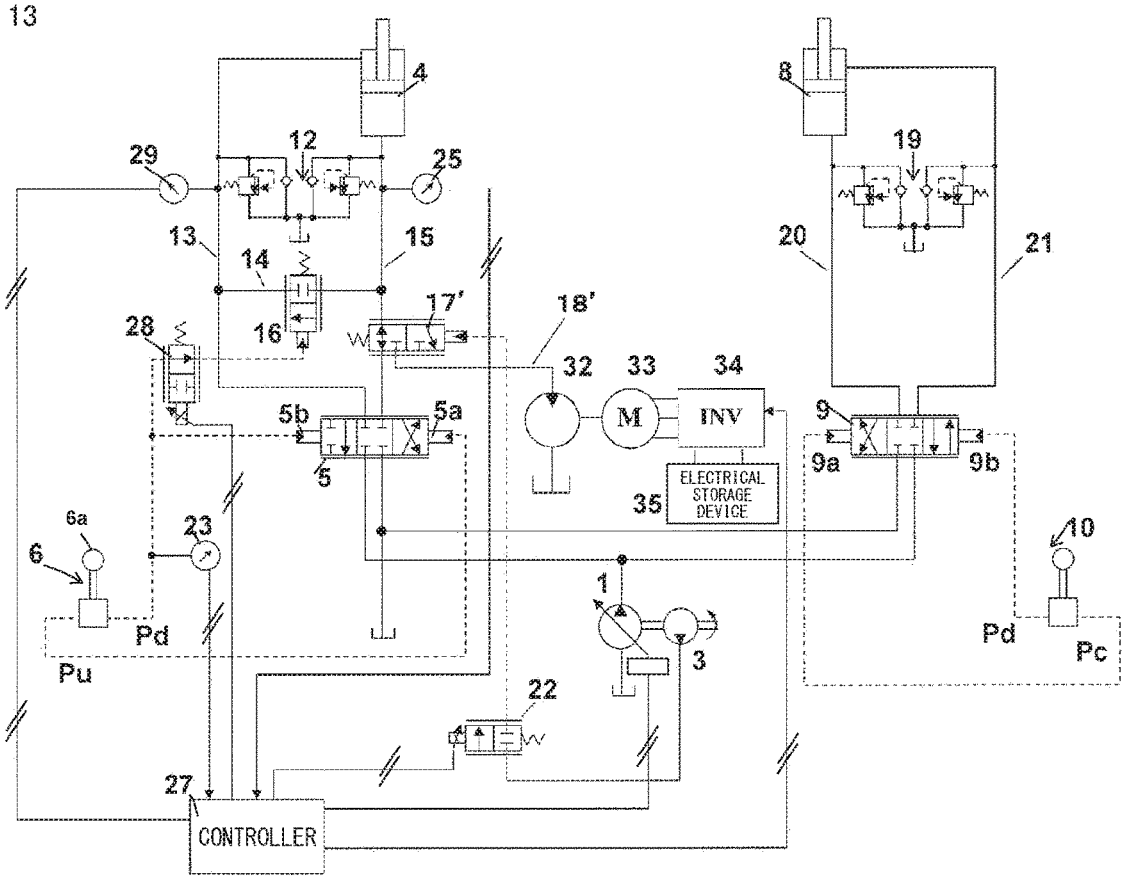
FIG. 13 is a schematic diagram showing a fifth embodiment of the hydraulic energy regeneration system for the work machine according to the present invention.

A fifth embodiment of the hydraulic energy regeneration system for the work machine according to the present invention will be described hereinafter with reference to the drawings. FIG. 13 is a schematic diagram showing the fifth embodiment of the hydraulic energy regeneration system for the work machine according to the present invention. In FIG. 13, constituent elements denoted by the same reference characters as those shown in FIGS. 1 to 12 are the same as those in FIGS. 1 to 12; detailed explanation thereof will be omitted.

The fifth embodiment of the hydraulic energy regeneration system for the work machine according to the present invention differs from the first embodiment in that a regeneration destination connected to a regeneration control valve 17' is a regeneration system that converts hydraulic energy into electric energy as shown in FIG. 13.

In FIG. 13, a regeneration hydraulic motor 32 driven by the hydraulic fluid from the boom cylinder 4 is connected to the other end of a regeneration line 18' having one end connected to one outlet port of the regeneration control valve 17'. The regeneration system includes the regeneration hydraulic motor 32, an electric motor 33 that is mechanically coupled to the regeneration hydraulic motor 32 and that converts the hydraulic energy into the electric energy, an inverter 34 that controls the electric motor 33, and an electrical storage device 35 that stores the electric energy.

Such a configuration can store the hydraulic energy in the electrical storage device 35 as the electric energy by feeding the return hydraulic fluid discharged from the boom cylinder 4 to the regeneration hydraulic motor 32 via the regeneration control valve 17'.

Furthermore, low pressure, high flow rate hydraulic energy can be converted into high pressure, low flow rate hydraulic energy by boosting the pressure of the return hydraulic fluid from the boom cylinder 4 by the communication pressure boost valve 16. As a result, it is unnecessary to regenerate a high flow rate, so that it is possible to prevent the regeneration system from being made large in size and efficiently regenerate energy.

Moreover, it is possible to prevent the bottom pressure from reaching the overload relief set pressure and ensure favorable operability while suppressing the sudden pressure fluctuation by regulating the opening degree of the communication pressure boost valve 16 in response to the load pressure even when the load pressure of the boom cylinder 4 rises and the bottom pressure gets closer to the overload relief set pressure.

The fifth embodiment of the hydraulic energy regeneration system for the work machine according to the present invention described above can attain similar effects to those of the first embodiment.

According to the fifth embodiment of the hydraulic energy recovery system for the work machine according to the present invention described above, recovery efficiency is enhanced in the regeneration system using the electric motor. Therefore, even when the bottom pressure is boosted, it is possible to prevent the bottom pressure from reaching the overload relief set pressure and ensure favorable operability while suppressing the sudden pressure fluctuation that could occur when the regeneration passage is closed.

Sixth Embodiment

Figure 14:
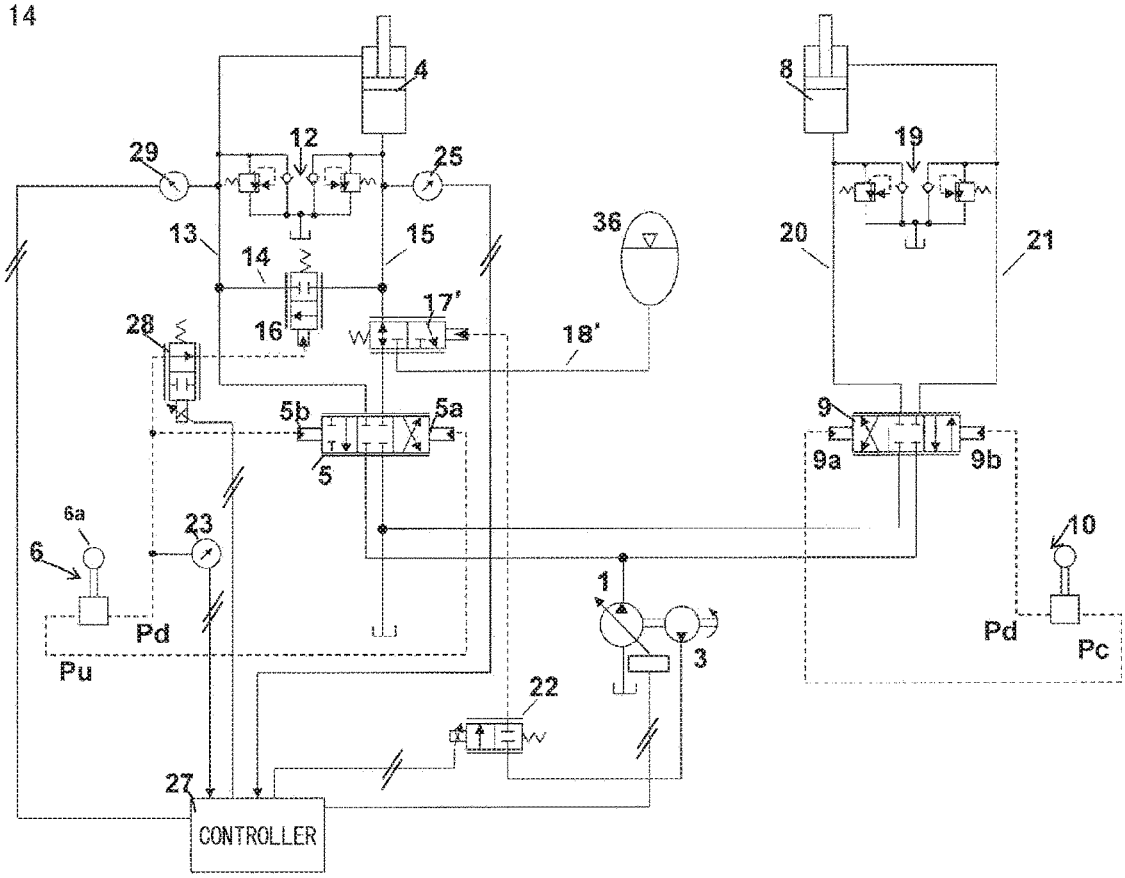
FIG. 14 is a schematic diagram showing a sixth embodiment of the hydraulic energy regeneration system for the work machine according to the present invention.

A sixth embodiment of the hydraulic energy regeneration system for the work machine according to the present invention will be described hereinafter with reference to the drawings. FIG. 14 is a schematic diagram showing the sixth embodiment of the hydraulic energy regeneration system for the work machine according to the present invention. In FIG. 14, constituent elements denoted by the same reference characters as those shown in FIGS. 1 to 13 are the same as those in FIGS. 1 to 13; detailed explanation thereof will be omitted.

The sixth embodiment of the hydraulic energy regeneration system for the work machine according to the present invention differs from the first embodiment in that a regeneration destination connected to the regeneration control valve 17' is an accumulator 36 that stores hydraulic energy as shown in FIG. 14. In FIG. 14, the accumulator 36 is connected to the other end of the regeneration line 18' having one end connected to one outlet port of the regeneration control valve 17'.

Such a configuration can store the return hydraulic fluid discharged from the boom cylinder 4 in the accumulator 36 via the regeneration control valve 17'. While it is necessary to set the bottom pressure higher than an inlet pressure of the accumulator 36 to store the return hydraulic fluid because of characteristics of the accumulator 36, the recovery efficiency can be enhanced since the communication pressure boost valve 16 can boost the pressure of the return hydraulic fluid from the boom cylinder 4.

Moreover, it is possible to prevent the bottom pressure from reaching the overload relief set pressure and ensure favorable operability while suppressing the sudden pressure fluctuation by regulating the opening degree of the communication pressure boost valve 16 in response to the load pressure even when the load pressure of the boom cylinder 4 rises and the bottom pressure gets closer to the overload relief set pressure.

The sixth embodiment of the hydraulic energy regeneration system for the work machine according to the present invention described above can attain similar effects to those of the first embodiment.

According to the sixth embodiment of the hydraulic energy recovery system for the work machine according to the present invention described above, the recovery efficiency is enhanced in the regeneration system using the accumulator 36. Therefore, even when the bottom pressure is boosted, it is possible to prevent the bottom pressure from reaching the overload relief set pressure and ensure favorable operability while suppressing the sudden pressure fluctuation that could occur when the regeneration passage is closed.

DESCRIPTION OF REFERENCE CHARACTERS

1: Hydraulic pump
3: Pilot pump
4: Boom cylinder
5: Control valve
6: First operation device
6*a*: Operation lever
6*b*: Pilot valve
8: Arm cylinder
9: Control valve
10: First operation device
10*a*: Operation lever
10*b*: Pilot valve
7*a*, 11*a*: Hydraulic fluid supply line
7*b*, 11*b*: Tank line
12: Overload relief valve with makeup valve
13: Rod-side line
14: Communication line
14A: Second communication line (second communication pressure boost passage)
15: Bottom-side line
16: Communication pressure boost valve
17: Reuse control valve
17': Regeneration control valve
18: Reuse line
18': Regeneration line
19: Overload relief valve with makeup valve
20: Bottom-side line
21: Rod-side line
22: Solenoid proportional valve
23, 24, 25, 26, 29: Pressure sensor
27: Controller
28: Solenoid proportional valve
30: Control valve (second communication pressure boost valve)
31: Control valve
32: Regeneration hydraulic motor
33: Electric motor
34: Inverter
35: Electrical storage device
36: Accumulator
123: Lever operation signal
124: Lever operation signal
125: Bottom pressure signal
126: Pump pressure signal
128: Solenoid valve command
129: Rod pressure signal
131: Function generator
133: Function generator
134: Function generator
135: Function generator
136: Integrator
138: Integrator
139: Function generator
140: Integrator
142: Integrator
144: Subtracter
148: Gain generator
149: Function generator
150: Integrator
151: Output conversion section
152: Output regulation section
152: Abnormality determination section
154: Integrator
160: Subtracter
161: Subtracter
162: Input conversion section
203: Front work implement
205: Boom
206: Arm
207: Bucket
201: Tilting command
222: Solenoid valve command

The invention claimed is:

1. A hydraulic energy regeneration system for a work machine, comprising:

a hydraulic cylinder that contracts during driving of a driven body or an own weight fall of the driven body;

a communication pressure boost passage that can boost a pressure of a bottom-side hydraulic chamber of the hydraulic cylinder by communicating a bottom-side hydraulic chamber and a rod-side hydraulic chamber of the hydraulic cylinder with each other during the own weight fall of the driven body;

a communication pressure boost valve that is disposed in the communication pressure boost passage and that can regulate one of or both of a pressure and a flow rate of the communication pressure boost passage;

a reuse-side line and a reuse control valve that can reuse a hydraulic fluid discharged from the bottom-side hydraulic chamber or a regeneration-side line and a regeneration control valve that can regenerate the hydraulic fluid discharged from the bottom-side hydraulic chamber as electric energy, during the own weight fall of the driven body;

a first pressure sensor that can detect the pressure of the bottom-side hydraulic chamber;

an operation device that causes the own weight fall of the driven body;

an operation amount sensor that detects an operation amount of the operation device; and a controller that is configured to input therein a signal indicating the pressure of the bottom-side hydraulic chamber detected by the first pressure sensor and a signal indicating the operation amount of the operation device detected by the operation amount sensor, and that can control the communication pressure boost valve, characterized in that the controller is configured to add a predetermined delay to the pressure of the bottom-side hydraulic chamber detected by the first pressure sensor and reduce an opening degree of the communication pressure boost valve in response to an increase of the pressure of the bottom-side hydraulic chamber having the delay right after the pressure of the bottom-side hydraulic chamber detected by the first pressure sensor reaches a preset high load set pressure, thereby gradually reducing the opening degree of the communication pressure boost valve with passage of time.

2. The hydraulic energy regeneration system for the work machine according to claim 1, comprising a second pressure sensor that can detect a pressure of the rod-side hydraulic chamber, wherein the controller is configured to input therein a signal indicating the pressure of the rod-side hydraulic chamber detected by the second pressure sensor, and controls the communication pressure boost valve in response to the signal indicating the pressure of the rod-side hydraulic chamber.

3. The hydraulic energy regeneration system for the work machine according to claim 2, wherein the controller further comprises an abnormality determination section that makes an abnormality determination that at least one of the first pressure sensor, the second pressure sensor, and the operation amount sensor is in an abnormal state when the at least one fails, and the controller is configured to gradually reduce the opening degree of the communication pressure boost valve with passage of time when the abnormality determination section determines the abnormal state.

4. The hydraulic energy regeneration system for the work machine according to claim 1, further comprising:

a second communication pressure boost passage that is disposed in parallel to the communication pressure boost passage and that communicates the bottom-side hydraulic chamber and the rod-side hydraulic chamber with each other during the own weight fall of the driven body; and a second communication pressure boost valve that is disposed in the second communication pressure boost passage and that can regulate one of or both of the pressure and the flow rate of the second communication pressure boost passage, wherein the operation device is a hydraulic pilot type of device, and an opening degree of the second communication pressure boost valve is regulated in response to the operation amount of the operation device.

5. The hydraulic energy regeneration system for the work machine according to claim 1, further comprising a third communication pressure boost valve that is disposed in the communication pressure boost passage in a relationship of being series to the communication pressure boost valve and that can regulate one of or both of the pressure and the flow rate of the communication pressure boost passage, wherein the operation device is a hydraulic pilot type of device, and an opening degree of the third communication pressure boost valve is regulated in response to the operation amount of the operation device.

6. The hydraulic energy regeneration system for the work machine according to claim 1, further comprising:

a hydraulic actuator other than the hydraulic cylinder; and a hydraulic pump that supplies a hydraulic fluid to the hydraulic actuator, wherein the reuse-side line and the reuse control valve reuse the hydraulic fluid discharged during the own weight fall of the driven body between the hydraulic actuator and the hydraulic pump.

7. The hydraulic energy regeneration system for the work machine according to claim 1, wherein the hydraulic fluid discharged from the hydraulic cylinder during the own weight fall of the driven body is supplied to a hydraulic motor via the regeneration-side line and the regeneration control valve.

8. The hydraulic energy regeneration system for the work machine according to claim 1, wherein the hydraulic fluid discharged from the hydraulic cylinder during the own weight fall of the driven body is supplied to an accumulator via the regeneration-side line and the regeneration control valve.

* * * * *